US008984895B2

(12) United States Patent
Kesseli et al.

(10) Patent No.: US 8,984,895 B2
(45) Date of Patent: Mar. 24, 2015

(54) METALLIC CERAMIC SPOOL FOR A GAS TURBINE ENGINE

(75) Inventors: James B. Kesseli, Greenland, NH (US); Matthew Stephen Baldwin, Exeter, NH (US)

(73) Assignee: ICR Turbine Engine Corporation, Hampton, NH (US)

( * ) Notice: Subject to any disclaimer, the term of this patent is extended or adjusted under 35 U.S.C. 154(b) by 908 days.

(21) Appl. No.: 13/180,275

(22) Filed: Jul. 11, 2011

(65) Prior Publication Data

US 2012/0017598 A1 Jan. 26, 2012

Related U.S. Application Data

(60) Provisional application No. 61/363,113, filed on Jul. 9, 2010.

(51) Int. Cl.
*F02C 7/20* (2006.01)
*F02C 7/28* (2006.01)
(Continued)

(52) U.S. Cl.
CPC ..... *F01D 15/02* (2013.01); *F01D 11/18* (2013.01)
USPC ..... 60/796; 60/806; 60/39.091; 415/200; 415/173.1; 415/173.5; 415/174.5

(58) Field of Classification Search
USPC ..... 60/805, 806, 782, 785, 39.83, 796, 798, 60/799, 779, 39.091; 415/1, 200, 415/134–136, 138, 170.1, 173.1–173.3, 415/173.5, 174.1–174.3, 174.5
See application file for complete search history.

(56) References Cited

U.S. PATENT DOCUMENTS 2,463,964 A 3/1949 Graf
2,543,677 A 2/1951 Traupel
(Continued)

FOREIGN PATENT DOCUMENTS

AT 311027 12/2005
AU 582981 4/1989
(Continued)

OTHER PUBLICATIONS

U.S. Appl. No. 13/215,026, filed Aug. 22, 2011, Donnelly et al.
(Continued)

*Primary Examiner* — Andrew Nguyen
(74) *Attorney, Agent, or Firm* — Sheridan Ross P.C.

(57) ABSTRACT

A method and apparatus are disclosed for a gas turbine spool design combining metallic and ceramic components in a way that controls clearances between critical components over a range of engine operating temperatures and pressures. In a first embodiment, a ceramic turbine rotor rotates just inside a ceramic shroud and separated by a small clearance gap. The ceramic rotor is connected to a metallic volute. In order to accommodate the differential rates of thermal expansion between the ceramic rotor and metallic volute, an active clearance control system is used to maintain the desired axial clearance between ceramic rotor and the ceramic shroud over the range of engine operating temperatures. In a second embodiment, a ceramic turbine rotor rotates just inside a ceramic shroud which is part of a single piece ceramic volute/shroud assembly. As temperature increases, the ceramic volute expands at approximately the same rate as ceramic shroud and tends to increase the axial clearance gap between the ceramic rotor and ceramic shroud, but only by a small amount compared to a metallic volute attached to the shroud in the same way.

22 Claims, 10 Drawing Sheets

(51) Int. Cl.

| | |
|---|---|
| ***F01D 11/14*** | (2006.01) |
| ***F01D 11/18*** | (2006.01) |
| ***F01D 15/02*** | (2006.01) |

(56) References Cited

U.S. PATENT DOCUMENTS 2,696,711 A 12/1954 Marchant et al.
2,711,071 A 6/1955 Frankel
3,032,987 A 5/1962 Taylor
3,091,933 A 6/1963 Wagner et al.
3,166,902 A 1/1965 Maljanian et al.
3,204,406 A 9/1965 Howes et al.
3,209,536 A 10/1965 Howes et al.
3,237,404 A 3/1966 Flanigan et al.
3,283,497 A 11/1966 Kaplan
3,319,931 A 5/1967 Bell III
3,518,472 A 6/1970 O'Callaghan
3,623,318 A * 11/1971 Shank ..... 60/806
3,639,076 A 2/1972 Rowen
3,646,753 A 3/1972 Stearns et al.
3,660,977 A 5/1972 Reynolds
3,706,203 A 12/1972 Goldberg et al.
3,729,928 A 5/1973 Rowen
3,748,491 A 7/1973 Barrigher et al.
3,764,814 A 10/1973 Griffith
3,766,732 A 10/1973 Woodcock
3,817,343 A 6/1974 Albrecht
3,848,636 A 11/1974 McCombs
3,866,108 A 2/1975 Yannone et al.
3,888,337 A 6/1975 Worthen et al.
3,893,293 A 7/1975 Moore
3,937,588 A 2/1976 Kisslan
3,939,653 A 2/1976 Schirmer
3,945,199 A 3/1976 Bradley et al.
3,953,967 A 5/1976 Smith
3,964,253 A 6/1976 Paduch et al.
3,977,183 A 8/1976 Stearns
3,986,364 A 10/1976 Cronin et al.
3,986,575 A 10/1976 Eggmann
3,999,373 A 12/1976 Bell et al.
3,999,375 A 12/1976 Smith et al.
4,002,058 A 1/1977 Wolfinger
4,005,946 A 2/1977 Brown et al.
4,027,472 A 6/1977 Stearns
4,027,473 A 6/1977 Baker
4,056,019 A 11/1977 Ahlen
4,059,770 A 11/1977 Mackay
4,067,189 A 1/1978 Earnest
4,082,115 A 4/1978 Gibb et al.
4,122,668 A 10/1978 Chou et al.
4,242,042 A 12/1980 Schwarz
4,242,871 A 1/1981 Breton
4,248,040 A 2/1981 Kast
4,270,357 A 6/1981 Rossi et al.
4,276,744 A 7/1981 Pisano
4,277,938 A 7/1981 Belke et al.
4,280,327 A 7/1981 Mackay
4,282,948 A 8/1981 Jerome
4,312,191 A 1/1982 Biagini
4,336,856 A 6/1982 Gamell
4,399,651 A 8/1983 Geary et al.
4,411,595 A 10/1983 Pisano
4,449,359 A 5/1984 Cole et al.
4,467,607 A 8/1984 Rydquist et al.
4,470,261 A 9/1984 Kronogard et al.
4,474,007 A 10/1984 Kronogard et al.
4,492,874 A 1/1985 Near
4,494,372 A 1/1985 Cronin
4,499,756 A 2/1985 Medeiros et al.
4,509,333 A 4/1985 Nussdorfer et al.
4,529,887 A 7/1985 Johnson
4,586,337 A 5/1986 Fox
4,754,607 A 7/1988 Mackay
4,783,957 A 11/1988 Harris
4,815,278 A 3/1989 White
4,819,436 A 4/1989 Ahner et al.
4,858,428 A 8/1989 Paul
4,864,811 A 9/1989 Pfefferle
5,010,729 A 4/1991 Adamson et al.
5,036,267 A 7/1991 Markunas et al.
5,069,032 A 12/1991 White
5,081,832 A 1/1992 Mowill
5,083,039 A 1/1992 Richardson et al.
5,090,193 A 2/1992 Schwarz et al.
5,097,658 A 3/1992 Klaass et al.
5,113,669 A 5/1992 Coffinberry
5,129,222 A 7/1992 Lampe et al.
5,144,299 A 9/1992 Smith
5,181,827 A * 1/1993 Pellow et al. ..... 415/173.3
5,214,910 A 6/1993 Adair
5,231,822 A 8/1993 Shekleton
5,253,470 A 10/1993 Newton
5,276,353 A 1/1994 Kobayashi et al.
5,301,500 A 4/1994 Hines
5,329,757 A 7/1994 Faulkner et al.
5,333,989 A 8/1994 Missana et al.
5,343,692 A 9/1994 Thomson et al.
5,349,814 A 9/1994 Ciokajlo et al.
5,386,688 A 2/1995 Nakhamkin
5,427,455 A 6/1995 Bosley
5,448,889 A 9/1995 Bronicki
5,450,724 A 9/1995 Kesseli et al.
5,488,823 A 2/1996 Faulkner et al.
5,497,615 A 3/1996 Noe et al.
5,529,398 A 6/1996 Bosley
5,549,174 A 8/1996 Reis
5,555,719 A 9/1996 Rowen et al.
5,564,270 A 10/1996 Kesseli et al.
5,586,429 A 12/1996 Kesseli et al.
5,609,655 A 3/1997 Kesseli et al.
5,610,962 A 3/1997 Solorzano et al.
5,625,243 A 4/1997 Lindgren et al.
5,667,358 A * 9/1997 Gaul ..... 415/173.2
5,685,156 A 11/1997 Willis et al.
5,697,848 A 12/1997 Bosley
5,722,259 A 3/1998 Sorensen et al.
5,742,515 A 4/1998 Runkle et al.
5,752,380 A 5/1998 Bosley et al.
5,784,268 A 7/1998 Steffek et al.
5,791,868 A 8/1998 Bosley et al.
5,819,524 A 10/1998 Bosley et al.
5,820,074 A 10/1998 Trommer et al.
5,827,040 A 10/1998 Bosley et al.
5,850,732 A 12/1998 Willis et al.
5,850,733 A 12/1998 Bosley et al.
5,873,235 A 2/1999 Bosley et al.
5,894,720 A 4/1999 Willis et al.
5,899,673 A 5/1999 Bosley et al.
5,903,116 A 5/1999 Geis et al.
5,915,841 A 6/1999 Weissert
5,918,985 A 7/1999 Bosley
5,928,301 A 7/1999 Soga et al.
5,929,538 A 7/1999 O'Sullivan et al.
5,954,174 A 9/1999 Costin
5,964,663 A 10/1999 Stewart et al.
5,966,926 A 10/1999 Shekleton et al.
5,983,986 A 11/1999 Macintyre et al.
5,983,992 A 11/1999 Child et al.
5,992,139 A 11/1999 Kesseli
6,002,603 A 12/1999 Carver
6,011,377 A 1/2000 Heglund et al.
6,016,658 A 1/2000 Willis et al.
6,020,713 A 2/2000 Geis et al.
6,023,135 A 2/2000 Gilbreth et al.
6,031,294 A 2/2000 Geis et al.
6,037,687 A 3/2000 Stewart et al.
6,049,195 A 4/2000 Geis et al.
6,062,016 A 5/2000 Edelman
6,065,281 A 5/2000 Shekleton et al.
6,070,404 A 6/2000 Bosley et al.
6,082,112 A 7/2000 Shekleton
6,085,524 A 7/2000 Persson
6,093,975 A 7/2000 Peticolas
6,094,799 A 8/2000 Stewart et al.

(56) References Cited

U.S. PATENT DOCUMENTS 6,107,693 A 8/2000 Mongia et al.
6,138,781 A 10/2000 Hakala
D433,997 S 11/2000 Laituri et al.
6,141,953 A 11/2000 Mongia et al.
6,155,076 A 12/2000 Cullen et al.
6,155,780 A 12/2000 Rouse
6,158,892 A 12/2000 Stewart et al.
6,169,334 B1 1/2001 Edelman
6,170,251 B1 1/2001 Skowronski et al.
6,178,751 B1 1/2001 Shekleton et al.
6,190,048 B1 2/2001 Weissert
6,192,668 B1 2/2001 Mackay
6,194,794 B1 2/2001 Lampe et al.
6,205,765 B1 3/2001 Iasillo et al.
6,205,768 B1 3/2001 Dibble et al.
6,213,234 B1 4/2001 Rosen et al.
6,239,520 B1 5/2001 Stahl et al.
6,265,786 B1 7/2001 Bosley et al.
6,274,945 B1 8/2001 Gilbreth et al.
6,281,596 B1 8/2001 Gilbreth et al.
6,281,601 B1 8/2001 Edelman et al.
6,305,079 B1 10/2001 Child et al.
6,314,717 B1 11/2001 Teets et al.
6,316,841 B1 11/2001 Weber
6,324,828 B1 12/2001 Willis et al.
6,324,846 B1 12/2001 Clarke
6,325,142 B1 12/2001 Bosley et al.
6,349,787 B1 2/2002 Dakhil
6,355,987 B1 3/2002 Bixel
6,361,271 B1 3/2002 Bosley
6,381,944 B2 5/2002 Mackay
6,405,522 B1 6/2002 Pont et al.
6,410,992 B1 6/2002 Wall et al.
6,425,732 B1 7/2002 Rouse et al.
6,437,468 B2 8/2002 Stahl et al.
6,438,936 B1 8/2002 Ryan
6,438,937 B1 8/2002 Pont et al.
6,453,658 B1 9/2002 Willis et al.
6,468,051 B2 10/2002 Lampe et al.
6,487,096 B1 11/2002 Gilbreth et al.
6,489,692 B1 12/2002 Gilbreth et al.
6,495,929 B2 12/2002 Bosley et al.
6,499,949 B2 12/2002 Schafrik et al.
6,522,030 B1 2/2003 Wall et al.
6,526,757 B2 3/2003 MacKay
6,539,720 B2 4/2003 Rouse et al.
6,542,791 B1 4/2003 Perez
6,543,232 B1 4/2003 Anderson et al.
6,552,440 B2 4/2003 Gilbreth et al.
6,574,950 B2 6/2003 Nash
6,598,400 B2 7/2003 Nash et al.
6,601,392 B2 8/2003 Child
6,605,928 B2 8/2003 Gupta et al.
6,606,864 B2 8/2003 Mackay
6,612,112 B2 9/2003 Gilbreth et al.
6,629,064 B1 9/2003 Wall
6,634,176 B2 10/2003 Rouse et al.
6,638,007 B2 * 10/2003 Bartholoma et al. ..... 415/9
6,639,328 B2 10/2003 Wacknov
6,644,916 B1 11/2003 Beacom
RE38,373 E 12/2003 Bosley
6,657,332 B2 12/2003 Balas
6,657,348 B2 12/2003 Qin et al.
6,663,044 B1 12/2003 Munoz et al.
6,664,653 B1 12/2003 Edelman
6,664,654 B2 12/2003 Wall et al.
6,670,721 B2 12/2003 Lof et al.
6,675,583 B2 1/2004 Willis et al.
6,683,389 B2 1/2004 Geis
6,684,642 B2 2/2004 Willis et al.
6,698,208 B2 3/2004 Teets
6,698,554 B2 3/2004 Desta et al.
6,702,463 B1 3/2004 Brockett et al.
6,709,243 B1 3/2004 Tan et al.
6,713,892 B2 3/2004 Gilbreth et al.
6,720,685 B2 4/2004 Balas
6,729,141 B2 5/2004 Ingram
6,732,531 B2 5/2004 Dickey
6,735,951 B2 5/2004 Thompson
6,745,574 B1 6/2004 Dettmer
6,747,372 B2 6/2004 Gilbreth et al.
6,748,742 B2 6/2004 Rouse et al.
6,751,941 B2 6/2004 Edelman et al.
6,766,647 B2 7/2004 Hartzheim
6,784,565 B2 8/2004 Wall et al.
6,787,933 B2 9/2004 Claude et al.
6,794,766 B2 9/2004 Wickert et al.
6,796,527 B1 9/2004 Munoz et al.
6,804,946 B2 10/2004 Willis et al.
6,810,677 B2 11/2004 Dewis
6,812,586 B2 11/2004 Wacknov et al.
6,812,587 B2 11/2004 Gilbreth et al.
6,815,932 B2 11/2004 Wall
6,817,575 B1 11/2004 Munoz et al.
6,819,999 B2 11/2004 Hartzheim
6,823,675 B2 11/2004 Brunell et al.
6,829,899 B2 12/2004 Benham, Jr. et al.
6,832,470 B2 12/2004 Dewis
6,834,226 B2 12/2004 Hartzheim
6,836,720 B2 12/2004 Hartzheim
6,837,419 B2 1/2005 Ryan
6,845,558 B2 1/2005 Beacom
6,845,621 B2 1/2005 Teets
6,847,129 B2 1/2005 McKelvey et al.
6,847,194 B2 1/2005 Sarlioglu et al.
6,848,249 B2 2/2005 Coleman et al.
6,863,509 B2 3/2005 Dewis
6,864,595 B2 3/2005 Wall
6,870,279 B2 3/2005 Gilbreth et al.
6,877,323 B2 4/2005 Dewis
6,883,331 B2 4/2005 Jonsson et al.
6,888,263 B2 5/2005 Satoh et al.
6,891,282 B2 5/2005 Gupta et al.
6,895,760 B2 5/2005 Kesseli
6,897,578 B1 5/2005 Olsen et al.
6,909,199 B2 6/2005 Gupta et al.
6,911,742 B2 6/2005 Gupta et al.
6,931,856 B2 8/2005 Belokon et al.
6,951,110 B2 10/2005 Kang
6,956,301 B2 10/2005 Gupta et al.
6,958,550 B2 10/2005 Gilbreth et al.
6,960,840 B2 11/2005 Willis et al.
6,964,168 B1 11/2005 Pierson et al.
6,966,173 B2 11/2005 Dewis
6,968,702 B2 11/2005 Child et al.
6,973,880 B2 12/2005 Kumar
6,977,446 B2 12/2005 Mackay
6,979,914 B2 12/2005 McKelvey et al.
6,983,787 B2 1/2006 Schoenenborn
6,989,610 B2 1/2006 Gupta et al.
6,998,728 B2 2/2006 Gupta et al.
7,019,626 B1 3/2006 Funk
7,053,590 B2 5/2006 Wang
7,059,385 B2 6/2006 Moilala
7,065,873 B2 6/2006 Kang et al.
RE39,190 E 7/2006 Weissert
7,092,262 B2 8/2006 Ryan et al.
7,093,443 B2 8/2006 McKelvey et al.
7,093,448 B2 * 8/2006 Nguyen et al. ..... 60/798
7,112,036 B2 9/2006 Lubell et al.
7,117,683 B2 10/2006 Thompson
7,147,050 B2 12/2006 Kang et al.
7,166,928 B2 1/2007 Larsen
7,181,337 B2 2/2007 Kosaka
7,185,496 B2 3/2007 Herlihy
7,186,200 B1 3/2007 Hauser
7,211,906 B2 5/2007 Teets et al.
7,224,081 B2 5/2007 Larsen
7,244,524 B2 7/2007 McCluskey et al.
7,266,429 B2 9/2007 Travaly et al.
7,285,871 B2 10/2007 Derouineau
7,299,638 B2 11/2007 Mackay
7,304,445 B2 12/2007 Donnelly
7,309,929 B2 12/2007 Donnelly et al.

(56) References Cited

U.S. PATENT DOCUMENTS 7,318,154 B2 1/2008 Tehee
7,325,401 B1 2/2008 Kesseli et al.
7,343,744 B2 3/2008 Abelson et al.
7,393,179 B1 7/2008 Kesseli et al.
7,398,642 B2 7/2008 McQuiggan
7,404,294 B2 7/2008 Sundin
7,415,764 B2 8/2008 Kang et al.
7,423,412 B2 9/2008 Weng et al.
7,464,533 B2 12/2008 Wollenweber
7,513,120 B2 4/2009 Kupratis
7,514,807 B2 4/2009 Donnelly et al.
7,518,254 B2 4/2009 Donnelly et al.
RE40,713 E 5/2009 Geis et al.
7,554,278 B2 6/2009 Wegner-Donnelly et al.
7,565,867 B2 7/2009 Donnelly et al.
7,572,531 B2 8/2009 Forte
7,574,853 B2 8/2009 Teets et al.
7,574,867 B2 8/2009 Teets et al.
7,595,124 B2 9/2009 Varatharajan et al.
7,605,487 B2 10/2009 Barton et al.
7,605,498 B2 10/2009 Ledenev et al.
7,607,318 B2 10/2009 Lui et al.
7,608,937 B1 10/2009 Altenschulte
7,614,792 B2 11/2009 Wade et al.
7,615,881 B2 11/2009 Halsey et al.
7,617,687 B2 11/2009 West et al.
7,656,135 B2 2/2010 Schram et al.
7,667,347 B2 2/2010 Donnelly et al.
7,671,481 B2 3/2010 Miller et al.
7,766,790 B2 8/2010 Stevenson et al.
7,770,376 B1 8/2010 Brostmeyer
7,777,358 B2 8/2010 Halsey et al.
7,804,184 B2 9/2010 Yuan et al.
7,841,185 B2 11/2010 Richards et al.
7,861,696 B2 1/2011 Lund
7,866,532 B1 1/2011 Potter et al.
7,906,862 B2 3/2011 Donnelly et al.
7,921,944 B2 4/2011 Russell et al.
7,926,274 B2 4/2011 Farkaly
7,944,081 B2 5/2011 Donnelly et al.
7,957,846 B2 6/2011 Hakim et al.
7,966,868 B1 6/2011 Sonnichsen et al.
7,977,845 B1 7/2011 Heitmann
8,008,808 B2 8/2011 Seeker et al.
8,015,812 B1 9/2011 Kesseli et al.
8,046,990 B2 11/2011 Bollinger et al.
8,055,526 B2 11/2011 Blagg et al.
8,188,693 B2 5/2012 Wei et al.
8,244,419 B2 8/2012 Wegner-Donnelly et al.
2001/0030425 A1 10/2001 Gilbreth et al.
2001/0052704 A1 12/2001 Bosley et al.
2002/0054718 A1 5/2002 Weissert
2002/0063479 A1 5/2002 Mitchell et al.
2002/0067872 A1 6/2002 Weissert
2002/0073688 A1 6/2002 Bosley et al.
2002/0073713 A1 6/2002 Mackay
2002/0079760 A1 6/2002 Vessa
2002/0083714 A1 7/2002 Bakholdin
2002/0096393 A1 7/2002 Rouse
2002/0096959 A1 7/2002 Qin et al.
2002/0097928 A1 7/2002 Swinton et al.
2002/0099476 A1 7/2002 Hamrin et al.
2002/0103745 A1 8/2002 Lof et al.
2002/0104316 A1 8/2002 Dickey et al.
2002/0110450 A1 8/2002 Swinton
2002/0119040 A1 8/2002 Bosley
2002/0120368 A1 8/2002 Edelman et al.
2002/0124569 A1 9/2002 Treece et al.
2002/0128076 A1 9/2002 Lubell
2002/0148229 A1 10/2002 Pont et al.
2002/0149205 A1 10/2002 Gilbreth et al.
2002/0149206 A1 10/2002 Gilbreth et al.
2002/0157881 A1 10/2002 Bakholdin et al.
2002/0158517 A1 10/2002 Rouse et al.
2002/0166324 A1 11/2002 Willis et al.
2003/0110773 A1 6/2003 Rouse et al.
2004/0008010 A1 1/2004 Ebrahim et al.
2004/0011038 A1 1/2004 Stinger et al.
2004/0035656 A1 2/2004 Anwar et al.
2004/0065293 A1 4/2004 Goto
2004/0080165 A1 4/2004 Geis et al.
2004/0090204 A1 5/2004 McGinley
2004/0103669 A1 6/2004 Willis et al.
2004/0106486 A1 6/2004 Jonsson
2004/0119291 A1 6/2004 Hamrin et al.
2004/0148942 A1 8/2004 Pont et al.
2004/0160061 A1 8/2004 Rouse et al.
2005/0000224 A1 1/2005 Jonsson
2005/0103931 A1 5/2005 Morris et al.
2005/0206331 A1 9/2005 Donnelly
2005/0228553 A1 10/2005 Tryon
2005/0229586 A1 10/2005 Whurr
2006/0076171 A1 4/2006 Donnelly et al.
2006/0090109 A1 4/2006 Bonnet
2007/0012129 A1 1/2007 Maty et al.
2007/0068712 A1 3/2007 Carnahan
2007/0178340 A1 8/2007 Eickhoff
2007/0181294 A1 8/2007 Soldner et al.
2007/0239325 A1 10/2007 Regunath
2007/0290039 A1 12/2007 Pfleging et al.
2008/0034759 A1* 2/2008 Bulman et al. ..... 60/796
2008/0080682 A1 4/2008 Ogunwale et al.
2008/0148708 A1 6/2008 Chou et al.
2008/0197705 A1 8/2008 Dewis et al.
2008/0208393 A1 8/2008 Schricker
2008/0243352 A1 10/2008 Healy
2008/0278000 A1 11/2008 Capp et al.
2009/0045292 A1 2/2009 Maddali et al.
2009/0071478 A1 3/2009 Kalfon
2009/0090109 A1 4/2009 Mills et al.
2009/0106978 A1 4/2009 Wollenweber
2009/0109022 A1 4/2009 Gangopadhyay et al.
2009/0158739 A1 6/2009 Messmer
2009/0193809 A1 8/2009 Schroder et al.
2009/0204316 A1 8/2009 Klampfl et al.
2009/0211260 A1 8/2009 Kesseli et al.
2009/0211739 A1 8/2009 Nash et al.
2009/0211740 A1 8/2009 Kesseli et al.
2009/0249786 A1 10/2009 Garrett et al.
2009/0271086 A1 10/2009 Morris et al.
2009/0292436 A1 11/2009 D'Amato et al.
2009/0313990 A1 12/2009 Mustafa
2009/0326753 A1 12/2009 Chen et al.
2010/0021284 A1 1/2010 Watson et al.
2010/0052425 A1 3/2010 Moore et al.
2010/0127570 A1 5/2010 Hadar et al.
2010/0154380 A1 6/2010 Tangirala et al.
2010/0229525 A1 9/2010 Mackay et al.
2010/0288571 A1 11/2010 Dewis et al.
2010/0293946 A1 11/2010 Vick
2010/0301062 A1 12/2010 Litwin et al.
2010/0319355 A1 12/2010 Prabhu
2011/0020108 A1 1/2011 Axelsson et al.
2011/0100777 A1 5/2011 Wilton et al.
2011/0215640 A1 9/2011 Donnelly
2011/0288738 A1 11/2011 Donnelly et al.
2011/0295453 A1 12/2011 Betz et al.
2012/0000204 A1 1/2012 Kesseli et al.
2012/0042656 A1 2/2012 Donnelly et al.
2012/0096869 A1 4/2012 Kesseli et al.
2012/0102911 A1 5/2012 Dewis et al.
2012/0175886 A1 7/2012 Donnelly et al.
2012/0201657 A1 8/2012 Donnelly et al.
2012/0260662 A1 10/2012 Nash et al.
2012/0324903 A1 12/2012 Dewis et al.
2013/0111923 A1 5/2013 Donnelly et al.
2013/0133480 A1 5/2013 Donnelly
2013/0139519 A1 6/2013 Kesseli et al.
2013/0294892 A1 11/2013 Dewis et al.
2013/0305730 A1 11/2013 Donnelly et al.
2014/0000275 A1 1/2014 Kesseli et al.

(56) References Cited

U.S. PATENT DOCUMENTS

| | | | |
|---|---|---|---|
| 2014/0026585 | A1 | 1/2014 | Baldwin |
| 2014/0196457 | A1 | 7/2014 | Kesseli et al. |

FOREIGN PATENT DOCUMENTS

| | | |
|---|---|---|
| AU | 587266 | 8/1989 |
| AU | 8517301 | 3/2002 |
| AU | 2025002 | 5/2002 |
| AU | 2589802 | 5/2002 |
| AU | 2004203836 | 3/2005 |
| AU | 2004208656 | 2/2009 |
| AU | 2004318142 | 6/2009 |
| CA | 1050637 | 3/1979 |
| CA | 1068492 | 12/1979 |
| CA | 1098997 | 4/1981 |
| CA | 1099373 | 4/1981 |
| CA | 1133263 | 10/1982 |
| CA | 1171671 | 7/1984 |
| CA | 1190050 | 7/1985 |
| CA | 1202099 | 3/1986 |
| CA | 1244661 | 11/1988 |
| CA | 1275719 | 10/1990 |
| CA | 2066258 | 3/1991 |
| CA | 1286882 | 7/1991 |
| CA | 2220172 | 5/1998 |
| CA | 2234318 | 10/1998 |
| CA | 2238356 | 3/1999 |
| CA | 2242947 | 3/1999 |
| CA | 2246769 | 3/1999 |
| CA | 2279320 | 4/2000 |
| CA | 2677758 | 4/2000 |
| CA | 2317855 | 5/2001 |
| CA | 2254034 | 6/2007 |
| CA | 2638648 | 2/2009 |
| CA | 2689188 | 7/2010 |
| CH | 595552 | 2/1978 |
| CH | 679235 | 1/1992 |
| CN | 1052170 | 6/1991 |
| CN | 1060270 | 4/1992 |
| CN | 1306603 | 8/2001 |
| CN | 1317634 | 10/2001 |
| CN | 1902389 | 1/2007 |
| CN | 101098079 | 1/2008 |
| CN | 100564811 | 12/2009 |
| CN | 101635449 | 1/2010 |
| CN | 101672252 | 3/2010 |
| CS | 9101996 | 1/1992 |
| CZ | 20014556 | 4/2003 |
| DE | 1272306 | 7/1968 |
| DE | 2753673 | 6/1978 |
| DE | 2853919 | 6/1979 |
| DE | 3140694 | 7/1982 |
| DE | 3736984 | 5/1988 |
| DE | 69519684 | 8/2001 |
| DE | 10305352 | 9/2004 |
| DE | 69828916 | 3/2006 |
| DE | 60125441 | 2/2007 |
| DE | 60125583 | 2/2007 |
| DK | 331889 | 7/1989 |
| EP | 0092551 | 11/1983 |
| EP | 0093118 | 11/1983 |
| EP | 0104921 | 4/1984 |
| EP | 0157794 | 10/1985 |
| EP | 0377292 | 7/1990 |
| EP | 0319246 | 10/1990 |
| EP | 0432753 | 6/1991 |
| EP | 0455640 | 11/1991 |
| EP | 0472294 | 2/1992 |
| EP | 0478713 | 4/1992 |
| EP | 0493481 | 7/1992 |
| EP | 0522832 | 1/1993 |
| EP | 0620906 | 10/1994 |
| EP | 0691511 | 1/1996 |
| EP | 0754142 | 1/1997 |
| EP | 0784156 | 12/1997 |
| EP | 0837224 | 4/1998 |
| EP | 0837231 | 4/1998 |
| EP | 0901218 | 3/1999 |
| EP | 0698178 | 6/1999 |
| EP | 0963035 | 12/1999 |
| EP | 1055809 | 11/2000 |
| EP | 1075724 | 2/2001 |
| EP | 1046786 | 1/2002 |
| EP | 1071185 | 1/2002 |
| EP | 1215393 | 6/2002 |
| EP | 0739087 | 8/2002 |
| EP | 1240713 | 9/2002 |
| EP | 1277267 | 1/2003 |
| EP | 1283166 | 2/2003 |
| EP | 1305210 | 5/2003 |
| EP | 1340301 | 9/2003 |
| EP | 1340304 | 9/2003 |
| EP | 1341990 | 9/2003 |
| EP | 1342044 | 9/2003 |
| EP | 1346139 | 9/2003 |
| EP | 1436504 | 7/2004 |
| EP | 1203866 | 8/2004 |
| EP | 0800616 | 12/2004 |
| EP | 1519011 | 3/2005 |
| EP | 1132614 | 1/2007 |
| EP | 1790568 | 5/2007 |
| EP | 1813807 | 8/2007 |
| EP | 1825115 | 8/2007 |
| EP | 1860750 | 11/2007 |
| EP | 1939396 | 7/2008 |
| EP | 2028104 | 2/2009 |
| EP | 1638184 | 3/2009 |
| EP | 1648096 | 7/2009 |
| EP | 2108828 | 10/2009 |
| EP | 1728990 | 11/2009 |
| EP | 2161444 | 3/2010 |
| EP | 2169800 | 3/2010 |
| EP | 1713141 | 5/2010 |
| EP | 1728304 | 6/2010 |
| EP | 1468180 | 7/2010 |
| FR | 2467286 | 11/1985 |
| FR | 2637942 | 4/1990 |
| FR | 2645908 | 10/1990 |
| FR | 2755319 | 4/1998 |
| FR | 2848647 | 6/2004 |
| GB | 612817 | 11/1948 |
| GB | 671379 | 5/1952 |
| GB | 673961 | 6/1952 |
| GB | 706743 | 4/1954 |
| GB | 731735 | 6/1955 |
| GB | 761955 | 11/1956 |
| GB | 768047 | 2/1957 |
| GB | 784119 | 10/1957 |
| GB | 786001 | 11/1957 |
| GB | 789589 | 1/1958 |
| GB | 807267 | 1/1959 |
| GB | 817507 | 7/1959 |
| GB | 834550 | 5/1960 |
| GB | 864712 | 4/1961 |
| GB | 874251 | 8/1961 |
| GB | 877838 | 9/1961 |
| GB | 878552 | 10/1961 |
| GB | 885184 | 12/1961 |
| GB | 917392 | 2/1963 |
| GB | 919540 | 2/1963 |
| GB | 920408 | 3/1963 |
| GB | 924078 | 4/1963 |
| GB | 931926 | 7/1963 |
| GB | 937278 | 9/1963 |
| GB | 937681 | 9/1963 |
| GB | 950015 | 2/1964 |
| GB | 950506 | 2/1964 |
| GB | 977402 | 12/1964 |
| GB | 993039 | 5/1965 |
| GB | 1004953 | 9/1965 |
| GB | 1008310 | 10/1965 |
| GB | 1009115 | 11/1965 |
| GB | 1012909 | 12/1965 |

(56) References Cited

FOREIGN PATENT DOCUMENTS

| | | | | |
|---|---|---|---|---|
| GB | 1043271 | | 9/1966 | |
| GB | 1083943 | | 9/1967 | |
| GB | 1097623 | | 1/1968 | |
| GB | 1103032 | | 2/1968 | |
| GB | 1127856 | | 9/1968 | |
| GB | 1137691 | | 12/1968 | |
| GB | 1138807 | | 1/1969 | |
| GB | 1141019 | | 1/1969 | |
| GB | 1148179 | | 4/1969 | |
| GB | 1158271 | | 7/1969 | |
| GB | 1172126 | | 11/1969 | |
| GB | 1174207 | | 12/1969 | |
| GB | 1211607 | | 11/1970 | |
| GB | 1270011 | | 4/1972 | |
| GB | 1275753 | | 5/1972 | |
| GB | 1275754 | | 5/1972 | |
| GB | 1275755 | | 5/1972 | |
| GB | 1301104 | | 12/1972 | |
| GB | 1348797 | | 3/1974 | |
| GB | 1392271 | | 4/1975 | |
| GB | 1454766 | | 11/1976 | |
| GB | 1460590 | | 1/1977 | |
| GB | 1516664 | | 7/1978 | |
| GB | 2019494 | | 10/1979 | |
| GB | 2074254 | | 10/1981 | |
| GB | 2089433 | | 6/1982 | |
| GB | 2123154 | | 1/1984 | |
| GB | 2174824 | | 11/1986 | |
| GB | 2184609 | | 6/1987 | |
| GB | 2199083 | | 6/1988 | |
| GB | 2211285 | | 6/1989 | |
| GB | 2218255 | | 11/1989 | |
| GB | 2232207 | | 12/1990 | |
| GB | 2341897 | | 3/2000 | |
| GB | 2355286 | | 4/2001 | |
| GB | 2420615 | | 5/2006 | |
| GB | 2426043 | | 11/2006 | |
| GB | 2435529 | | 8/2007 | |
| GB | 2436708 | | 10/2007 | |
| GB | 2441924 | | 3/2008 | |
| GB | 2442585 | | 4/2008 | |
| GB | 2456336 | | 7/2009 | |
| GB | 2456672 | | 7/2009 | |
| GB | 2447514 | | 12/2009 | |
| IN | 4946DELNP2006 | | 8/2007 | |
| IN | 4341DELNP2005 | | 10/2007 | |
| IN | 5879DELNP2008 | | 9/2008 | |
| IN | 2502DEL2005 | | 10/2009 | |
| IN | 1913DEL2009 | | 6/2010 | |
| IN | 55DEL2010 | | 7/2010 | |
| IN | 2013DEL2009 | | 7/2010 | |
| IT | 1173399 | | 6/1987 | |
| IT | 1194590 | | 9/1988 | |
| IT | MI911564 | | 1/1992 | |
| JP | 51-065252 | | 6/1976 | |
| JP | 56-088920 | | 7/1981 | |
| JP | 56-148624 | | 11/1981 | |
| JP | 56-148625 | | 11/1981 | |
| JP | 59010709 | * | 1/1984 | ..... F01D 25/14 |
| JP | 60-184973 | | 9/1985 | |
| JP | 60184906 | * | 9/1985 | ..... F01D 11/08 |
| JP | 61-182489 | | 8/1986 | |
| JP | 3182638 | | 8/1991 | |
| JP | 6201891 | | 7/1994 | |
| JP | 2519620 | | 7/1996 | |
| JP | 10-054561 | | 2/1998 | |
| JP | 10-061660 | | 3/1998 | |
| JP | 10-115229 | | 5/1998 | |
| JP | 10-122180 | | 5/1998 | |
| JP | 11-324727 | | 11/1999 | |
| JP | 2000-054855 | | 2/2000 | |
| JP | 2000-130319 | | 5/2000 | |
| JP | 2000-329096 | | 11/2000 | |
| JP | 2002-030942 | | 1/2002 | |
| JP | 2002-115565 | | 4/2002 | |
| JP | 2003-009593 | | 1/2003 | |
| JP | 2003-013744 | | 1/2003 | |
| JP | 2003-041906 | | 2/2003 | |
| JP | 2004-163087 | | 6/2004 | |
| JP | 2005-345095 | | 12/2005 | |
| JP | 2006-022811 | | 1/2006 | |
| JP | 2006-170208 | | 6/2006 | |
| JP | 2006-174694 | | 6/2006 | |
| JP | 2006-200438 | | 8/2006 | |
| JP | 2007-231949 | | 9/2007 | |
| JP | 2008-111438 | | 5/2008 | |
| JP | 2008-132973 | | 6/2008 | |
| JP | 2009-108756 | | 5/2009 | |
| JP | 2009-108860 | | 5/2009 | |
| JP | 2009-209931 | | 9/2009 | |
| JP | 2009-216085 | | 9/2009 | |
| JP | 2009-250040 | | 10/2009 | |
| JP | 2010-014114 | | 1/2010 | |
| JP | 2010-106835 | | 5/2010 | |
| KR | 19840002483 | | 12/1984 | |
| KR | 880002362 | | 10/1988 | |
| KR | 890001170 | | 4/1989 | |
| KR | 1020010007189 | | 1/2001 | |
| KR | 1020020024545 | | 3/2002 | |
| KR | 1020030032864 | | 4/2003 | |
| KR | 1020060096320 | | 9/2006 | |
| KR | 1020070078978 | | 8/2007 | |
| KR | 1020070113990 | | 11/2007 | |
| KR | 1020080033866 | | 4/2008 | |
| KR | 1020090121248 | | 11/2009 | |
| NL | 7903120 | | 10/1979 | |
| SE | 437543 | | 3/1985 | |
| SE | 9901718 | | 5/1999 | |
| SE | 0103180 | | 3/2003 | |
| WO | WO 8501326 | | 3/1985 | |
| WO | WO 9207221 | | 4/1992 | |
| WO | WO 9524072 | | 9/1995 | |
| WO | WO 9722176 | | 6/1997 | |
| WO | WO 9722789 | | 6/1997 | |
| WO | WO 9726491 | | 7/1997 | |
| WO | WO 9825014 | | 6/1998 | |
| WO | WO 9854448 | | 12/1998 | |
| WO | WO 9919161 | | 4/1999 | |
| WO | WO 0140644 | | 6/2001 | |
| WO | WO 0182448 | | 11/2001 | |
| WO | WO 0202920 | | 1/2002 | |
| WO | WO 0240844 | | 5/2002 | |
| WO | WO 0242611 | | 5/2002 | |
| WO | WO 0244574 | | 6/2002 | |
| WO | WO 0250618 | | 6/2002 | |
| WO | WO 0237638 | | 9/2002 | |
| WO | WO 0229225 | | 2/2003 | |
| WO | WO 0239045 | | 2/2003 | |
| WO | WO 03093652 | | 6/2004 | |
| WO | WO 2004077637 | | 9/2004 | |
| WO | WO 2005045345 | | 5/2005 | |
| WO | WO 2005099063 | | 10/2005 | |
| WO | WO 2008044972 | | 4/2008 | |
| WO | WO 2008044973 | | 4/2008 | |
| WO | WO 2008082334 | | 7/2008 | |
| WO | WO 2008082335 | | 7/2008 | |
| WO | WO 2008082336 | | 7/2008 | |
| WO | WO 2009067048 | | 5/2009 | |
| WO | WO 2010050856 | | 5/2010 | |
| WO | WO 2010082893 | | 7/2010 | |
| ZA | 8608745 | | 7/1987 | |

OTHER PUBLICATIONS

U.S. Appl. No. 13/226,156, filed Sep. 6, 2011, Donnelly et al.

U.S. Appl. No. 13/281,702, filed Oct. 26, 2011, Kesseli et al.

U.S. Appl. No. 13/281,725, filed Oct. 26, 2011, Dewis et al.

"A High-Efficiency ICR Microturbine for Commercial Vehicle Propulsion," PACCAR, date unknown, 11 pages.

"Benefits of the Microturbine to Power the Next Generation of Trucks." Kenworth Truck Company, date unknown, 9 pages.

"Why Gas Turbines have a Future in Heavy Duty Trucks." Capstone Turbine Corporation, Brayton Energy, LLC, Kenworth Truck Com-

(56) References Cited

OTHER PUBLICATIONS pany, a PACCAR Company, Peterbilt Truck Company, a PACCAR Company, Apr. 2009, 10 pages.
Mackay et al. "High Efficiency Vehicular Gas Turbines," SAE International, 2005, 10 pages.
Wolf et al. "Preliminary Design and Projected Performance for Intercooled-Recuperated Microturbine," Proceedings of the ASME TurboExpo 2008 Microturbine and Small Turbomachinery Systems, Jun. 9-13, 2008, Berlin, Germany, 10 pages.
U.S. Appl. No. 13/039,088, filed Mar. 2, 2011, Donnelly.
U.S. Appl. No. 13/175,564, filed Jul. 1, 2011, Kesseli et al.
U.S. Appl. No. 13/210,121, filed Aug. 15, 2011, Donnelly et al.
U.S. Appl. No. 13/090,104, filed Apr. 19, 2011, Donnelly et al.
U.S. Appl. No. 61/501,552. filed Jun. 27, 2011, Kesseli et al.
Background of the Invention for the above-captioned application (previously provided).
"Analysis of Technology Options to Reduce the Fuel Consumption of Idling Trucks," Stodolsky, F., L. Gaines, and A. Vyas, Argonne National Laboratory, ANL/ESD-43, Jun. 2000, 40 pages.
Balogh et al. "DC Link Floating for Grid Connected PV Converters," World Academy of Science, Engineering and Technology Apr. 2008, Iss. 40, pp. 115-120.
Nemeth et al. "Life Predicted in a Probabilistic Design Space for Brittle Materials With Transient Loads," NASA, last updated Jul. 21, 2005, found at http://www.grc.nasa.gov/WWW/RT/2004/RS/RS06L-nemeth.html, 5 pages.
"Remy HVH250-090-SOM Electric Motor," Remy International, Inc., 2011, 2 pages.
Gieras et al., "Performance Calculation for a High-Speed Solid-Rotor Induction Motor," IEEE Transactions on Industrial Electronics, 2012, vol. 59, No. 6, pp. 2689-2700.

* cited by examiner

METALLIC CERAMIC SPOOL FOR A GAS TURBINE ENGINE

CROSS REFERENCE TO RELATED APPLICATION

The present application claims the benefits, under 35 U.S.C. §119(e), of U.S. Provisional Application Ser. No. 61/363,113 entitled "Metallic Ceramic Spool for a Gas Turbine Engine" filed on Jul. 9, 2010, which is incorporated herein by reference.

FIELD

The present invention relates generally to gas turbine engines and in particular to a gas turbine spool design combining metallic and ceramic components.

BACKGROUND

There is a growing requirement for alternate fuels for vehicle propulsion and power generation. These include fuels such as natural gas, bio-diesel, ethanol, butanol, hydrogen and the like. Means of utilizing fuels needs to be accomplished more efficiently and with substantially lower carbon dioxide emissions and other air pollutants such as NOxs.

The gas turbine or Brayton cycle power plant has demonstrated many attractive features which make it a candidate for advanced vehicular propulsion as well as power generation. Gas turbine engines have the advantage of being highly fuel flexible and fuel tolerant. Additionally, these engines burn fuel at a lower temperature than comparable reciprocating engines so produce substantially less NOx per mass of fuel burned.

A multi-spool intercooled, recuperated gas turbine system is particularly suited for use as a power plant for a vehicle, especially a truck, bus or other overland vehicle. However, it has broader applications and may be used in many different environments and applications, including as a stationary electric power module for distributed power generation.

The thermal efficiency of gas turbine engines has been steadily improving as the use of new materials and new design tools are being brought to bear on engine design. One of the important advances has been the use of ceramics in various gas turbine engine components which has allowed the use of higher temperature operation and reduced component weight. The use of both metallic and ceramic components in an engine which may have wide variations in operating temperatures, means that special attention be given to the interfaces of the these different materials to preserve the intended component clearances. Control of clearances generally leads to fewer parasitic performance losses. Fewer parasitic performance losses incrementally improves engine efficiency.

There therefore remains a need for innovative designs for gas turbine compressor/turbine spools fabricated from a combination of metallic and ceramic materials that maintain a desired control of clearances between various compressor and turbine components.

SUMMARY

These and other needs are addressed by the various embodiments and configurations of the present invention which are directed generally to a gas turbine spool assembly design combining metallic and ceramic components in a way that controls clearances between critical components over a substantial range of engine operating temperatures and pressures.

In a first embodiment, a ceramic turbine rotor rotates just inside a ceramic shroud and separated by a small clearance gap. The ceramic rotor is connected to a metallic volute. In order to accommodate the differential rates of thermal expansion between the ceramic rotor and metallic volute, an active clearance control system is used to maintain the desired axial clearance between ceramic rotor and the ceramic shroud over the range of engine operating temperatures. This clearance control means is comprised of an impingement-cooled conical arm, a shroud carrier and a sliding seal system that allows the metallic volute to expand and move independently of the ceramic shroud thus allowing the clearance gap between ceramic rotor and ceramic shroud to remain substantially constant.

With proper design of the impingement cooling air flow and conical arm, the clearance control system can automatically maintain an approximately constant width of clearance gap between the rotor blades and the shroud over most or all of the operating conditions of the engine, from idle to full power. This in turn minimizes leakage of gas flow between the rotor blades and shroud. This clearance control system thus allows metallic and ceramic components to be used without compromising overall engine efficiency. As can be appreciated, the active clearance control system described herein can be designed to 1) maintain an approximately constant width of clearance gap between the rotor blades and the shroud over most or all of the operating conditions of the engine; 2) a slightly decreasing width of clearance gap between the rotor blades and the shroud over most or all of the operating conditions of the engine; 3) a slightly increasing width of clearance gap between the rotor blades and the shroud over most or all of the operating conditions of the engine; or 4) a prescribed width of clearance gap between the rotor blades and the shroud over most or all of the operating conditions of the engine.

In a second embodiment, a ceramic turbine rotor rotates just inside a ceramic shroud which is part of a single piece ceramic volute/shroud assembly. As temperature increases, the ceramic volute expands at approximately the same rate as ceramic shroud and tends to increase the axial clearance gap between the ceramic rotor and ceramic shroud, but only by a small amount compared to a metallic volute attached to the shroud in the same way. A compliant metallic bellows connecting the outer case of the turbo-compressor spool assembly and the ceramic shroud does not allow the case to pull shroud away from the rotor.

In one embodiment, a gas turbine engine comprising at least one turbo-compressor spool assembly, wherein the at least one turbo-compressor spool assembly comprises a compressor in mechanical communication with a turbine, a volute directing an inlet gas towards an inlet of a rotor of the turbine and a shroud adjacent to the rotor of the turbine, the shroud directing an outlet gas towards an outlet of the at least one turbo-compressor spool assembly and a clearance control device to substantially maintain, during the at least one turbo-compressor spool assembly operation, an operational clearance between the rotor and shroud at a level no greater than about 110% of a non-operational clearance between the rotor and shroud when the at least one turbo-compressor spool assembly is non-operational.

In another embodiment, a method, comprising providing an engine comprising at least one turbo-compressor spool assembly, wherein the at least one turbo-compressor spool assembly comprises a compressor in mechanical communication with a turbine, a volute adjacent to a rotor of the turbine directing an inlet gas towards an inlet of the turbine rotor, and a shroud adjacent to the turbine rotor, the shroud directing an outlet gas towards an outlet of the at least one turbo-compressor spool assembly and substantially maintaining, during the at least one turbo-compressor spool assembly operation, an operational clearance between the rotor and shroud at a level no greater than about 110% of a non-operational clearance between the rotor and shroud when the at least one turbo-compressor spool assembly is non-operational.

In another embodiment, a gas turbine engine, comprising at least one turbo-compressor spool assembly, wherein the at least one turbo-compressor spool assembly comprises a compressor in mechanical communication with a turbine, a volute directing an input gas to a rotor of the turbine, and a shroud adjacent to the turbine rotor, the shroud directing an outlet gas towards an outlet of the at least one turbo-compressor spool assembly, wherein the volute and shroud each comprise a ceramic material to maintain, during the at least one turbo-compressor spool assembly operation, at least an operational clearance between the rotor and shroud of no more than about 110% of a non-operational clearance between the rotor and shroud when the at least one turbo-compressor spool assembly is non-operational.

The present invention is illustrated for a gas turbine engine with an output shaft power in the range from about 200 to about 375 kW. The diameter of the ceramic turbine rotor is about 95 mm and the desired clearance gap between the ceramic rotor and shroud is about 0.38 mm. The diameter of the ceramic turbine rotor commonly ranges from about 75 to about 125 mm, more commonly from about 85 to about 115 mm, and even more commonly is about 95-mm and the desired clearance gap between the ceramic rotor and shroud commonly ranges from about 0.25 to about 0.50 mm, more commonly ranges from about 0.30 to about 0.45 mm, and even more commonly is about 0.38 mm. Without impingement cooling, the axial motion of the shroud with respect to the rotor at operating temperature is in the range of about 0.7 to about 1 mm which will substantially increase the clearance gap between the ceramic rotor and shroud. The clearance gap increases from the desired 0.38 mm to as much as about 1 mm, or a potential three-fold (about 300%) increase in gap width which, in turn, would result in an approximately three-fold increase in leakage mass flow rate. The present disclosure, by contrast, can maintain the axial motion of the shroud at operating temperature to a level commonly of less than about 0.06 mm, more commonly of no more than about 0.05 mm, more commonly of no more than about 0.04 mm, more commonly of no more than about 0.03 mm, and even more commonly of no more than about 0.02 mm. Stated differently, the axial motion of the shroud at operating temperature is maintained at a level of commonly no more than about 16%, more commonly no more than about 13%, more commonly no more than about 10.5%, more commonly no more than about 8.0%, and even more commonly no more than about 5%.

As can be appreciated, the impingement-cooling-driven clearance control method of the present invention can be applied to any spool of any size gas turbine engine.

These and other advantages will be apparent from the disclosure of the invention(s) contained herein.

The above-described embodiments and configurations are neither complete nor exhaustive. As will be appreciated, other embodiments of the invention are possible utilizing, alone or in combination, one or more of the features set forth above or described in detail below.

The following definitions are used herein:

Ceramic refers to an inorganic, nonmetallic solid prepared by the action of heat and subsequent cooling. Ceramic materials may have a crystalline or partly crystalline structure, or may be amorphous (e.g., a glass). Some properties of several ceramics used in gas turbines are shown in Table 1.

An engine is a prime mover and refers to any device that uses energy to develop mechanical power, such as motion in some other machine. Examples are diesel engines, gas turbine engines, microturbines, Stirling engines and spark ignition engines A gasifier is that portion of a gas turbine engine that produce the energy in the form of pressurized hot gasses that can then be expanded across the free power turbine to produce energy.

A gas turbine engine as used herein may also be referred to as a turbine engine or microturbine engine. A microturbine is commonly a sub category under the class of prime movers called gas turbines and is typically a gas turbine with an output power in the approximate range of about a few kilowatts to about 700 kilowatts. A turbine or gas turbine engine is commonly used to describe engines with output power in the range above about 700 kilowatts. As can be appreciated, a gas turbine engine can be a microturbine since the engines may be similar in architecture but differing in output power level. The power level at which a microturbine becomes a turbine engine is arbitrary and the distinction has no meaning as used herein.

A recuperator as used herein is a gas-to-gas heat exchanger dedicated to returning exhaust heat energy from a process back into the pre-combustion process to increase process efficiency. In a gas turbine thermodynamic cycle, heat energy is transferred from the turbine discharge to the combustor inlet gas stream, thereby reducing heating required by fuel to achieve a requisite firing temperature.

A regenerator is a heat exchanger that transfers heat by submerging a matrix alternately in the hot and then the cold gas streams wherein the flow on the hot side of the heat exchanger is typically exhaust gas and the flow on cold side of the heat exchanger is typically gas entering the combustion chamber.

Spool means a group of turbo machinery components on a common shaft.

A turbine is any machine in which mechanical work is extracted from a moving fluid by expanding the fluid from a higher pressure to a lower pressure.

Turbine Inlet Temperature (TIT) as used herein refers to the gas temperature at the outlet of the combustor which is closely connected to the inlet of the high pressure turbine and these are generally taken to be the same temperature.

A turbo-compressor spool assembly as used herein refers to an assembly typically comprised of an outer case, a radial compressor, a radial turbine wherein the radial compressor and radial turbine are attached to a common shaft. The assembly also includes inlet ducting for the compressor, a compressor rotor, a diffuser for the compressor outlet, a volute for incoming flow to the turbine, a turbine rotor and an outlet diffuser for the turbine. The shaft connecting the compressor and turbine includes a bearing system. An example of a turbo-compressor spool assembly is shown in FIG. 5 herein.

A volute is a scroll transition duct which looks like a tuba or a snail shell. Volutes may be used to channel flow gases from one component of a gas turbine to the next. Gases flow through the helical body of the scroll and are redirected into the next component. A key advantage of the scroll is that the device inherently provides a constant flow angle at the inlet and outlet. To date, this type of transition duct has only been successfully used on small engines or turbochargers where the geometrical fabrication issues are less involved.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention. In the drawings, like reference numerals refer to like or analogous components throughout the several views

DETAILED DESCRIPTION

Gas Turbine Engine Architecture

Figure 1:
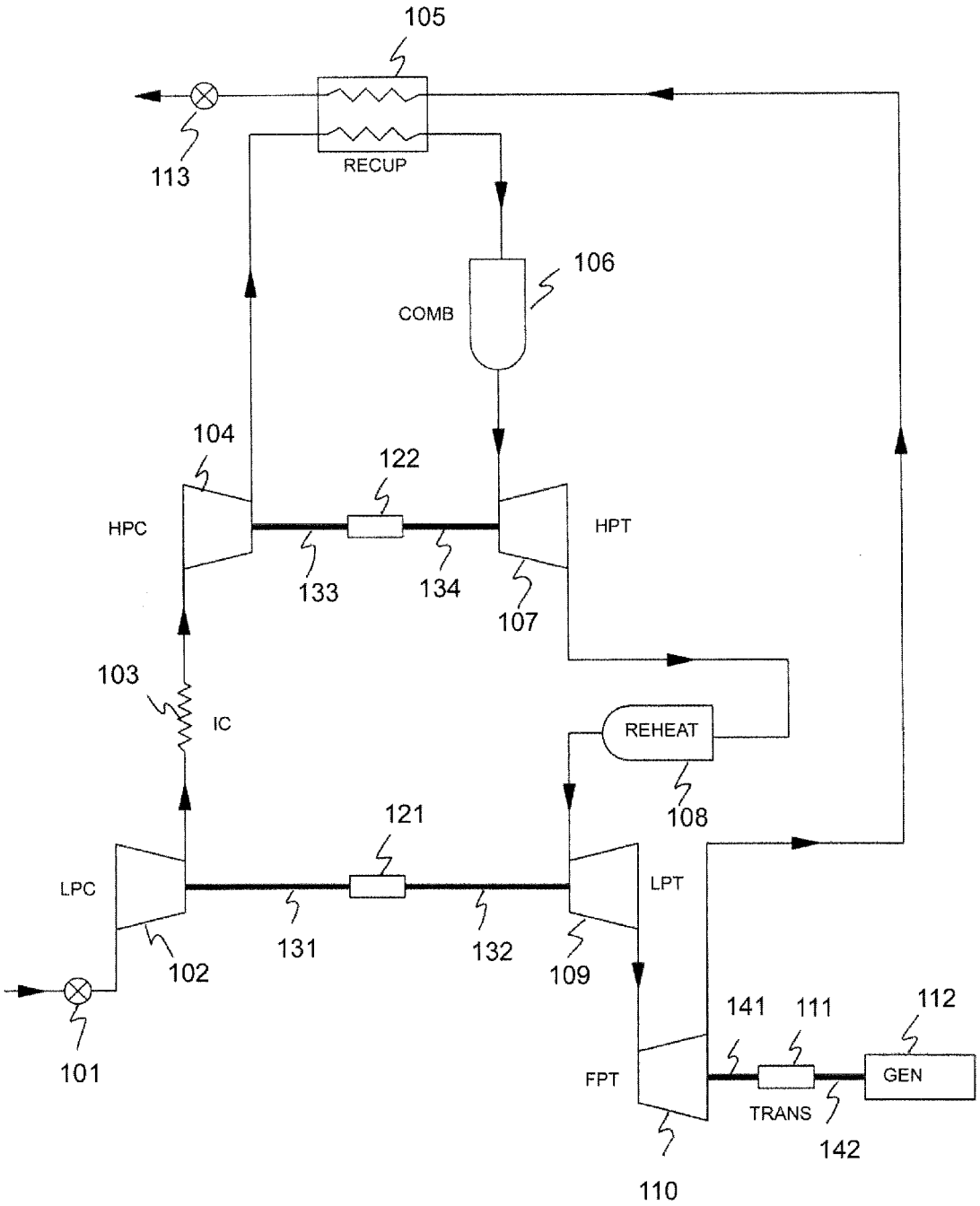
Figure 1 (Prior Art)
FIG. 1 is a schematic of an intercooled, recuperated gas turbine engine cycle with reheat. This is prior art.

FIG. 1 is a schematic of an intercooled, recuperated gas turbine engine cycle with reheat. This configuration of gas turbine components is known. Gas is ingested through optional valve 101 into a low pressure compressor (LPC) 102. The outlet of the low pressure compressor 102 passes through an intercooler (IC) 103, which removes a portion of heat from the gas stream at approximately constant pressure. The gas then enters a high pressure compressor (HPC) 104. The outlet of high pressure compressor 104 passes through a recuperator (RECUP) 105 where some heat from the exhaust gas is transferred, at approximately constant pressure, to the gas flow from the high pressure compressor 104. The further heated gas from recuperator 105 is then directed to a combustor (COMB) 106 where a fuel is burned, adding heat energy to the gas flow at approximately constant pressure. The gas emerging from the combustor 106 then enters a high pressure turbine (HPT) 107 where work is done by the turbine to operate the high pressure compressor. The gas from the high pressure turbine 107 then enters a reheat combustor (REHEAT) 108 where additional fuel is burned, adding heat energy to the gas flow, again at approximately constant pressure. The gas from the reheater 108 then drives a low pressure turbine (LPT) 109 where work is done by the turbine to operate the low pressure compressor. The gas from the low pressure turbine 109 then drives a free power turbine (FPT) 110 where energy is extracted and converted to rotary mechanical energy of a shaft. The shaft of the free power turbine 110, in turn, drives a transmission (TRANS) 111 which drives an electrical generator (GEN) or mechanical drive shaft 112. As can be appreciated, an alternate version of this engine architecture can omit the reheat combustor 108 or relocate reheat combustor 108 between low pressure turbine 109 and free power turbine 110.

The low pressure compressor 102 is coupled to the low pressure turbine 109 by shafts 131 and 132 which may be coupled by a gear box 121. Alternately, the low pressure compressor 102 may be coupled to the low pressure turbine 109 by a single shaft. The components including low pressure compressor 102, shafts 131 and 132, gear box 121 and low pressure turbine 109 comprise the low pressure spool of the gas turbine engine.

The high pressure compressor 104 is coupled to the high pressure turbine 107 by shafts 133 and 134 which may be coupled by a gear box 122. Alternately, the high pressure compressor 104 may be coupled to the high pressure turbine 107 by a single shaft. The components including high pressure compressor 104, shafts 133 and 134, gear box 122 and high pressure turbine 107 comprise the high pressure spool of the gas turbine engine.

The various components described above may be made from a variety of materials depending on the mechanical and thermal stresses they are expected to encounter, especially in a vehicle engine application where components may be subjected to a range of mechanical and thermal stresses as the engine load varies from idle to full power. For example, the low pressure spool components may be made from metals, typically steel alloys, titanium and the like. The high pressure spool components may be made from a combination of metals and ceramics. For example, the turbine rotors may be made from silicon nitride while turbine shroud and volutes may be made from ceramics such as silicon carbide. The compressor and turbine housings or cases are generally made of steel to contain a potentially fragmenting ceramic volute, rotor or shroud.

The combustor and reheater may be made from metals but they may also be made from ceramics. For example, a ceramic thermal oxidizer (also known as a thermal reactor) may function as a high-temperature combustor or as a reheater.

Metals, for example, offer strength and ductility for lower temperature components. Ceramics offer light weight for high rpm components and excellent thermal performance for higher temperature components. Higher temperature operation especially in the combustors and high pressure turbine rotors can lead to higher overall thermal engine efficiencies and lower engine fuel consumption. Thus, in the quest for better engine performance, ceramics will be used more and more and in combination with metal components. One of the impediments to achieving efficiency gains by the use of both metals and ceramics is the parasitic flow losses that can result when these materials are used together over a variable range of temperatures. These losses occur because of the differential thermal expansion rates of ceramics and metals.

Ceramic Materials

Figure 2:
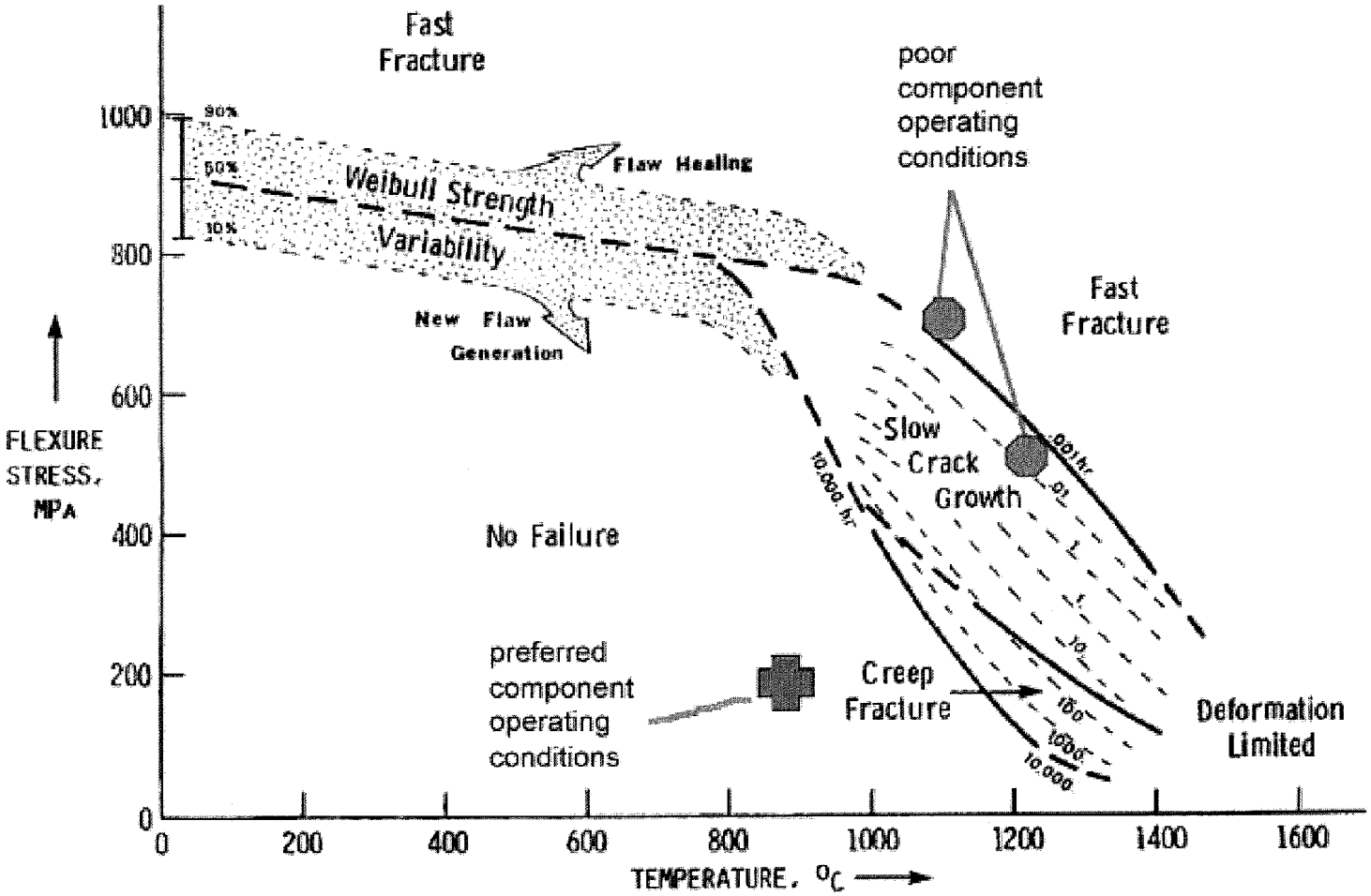
FIG. 2 is a stress-temperature map showing ceramic failure regimes.

FIG. 2 is a stress-temperature map illustrating ceramic failure regimes. This graphic shows that if flexure stress and temperature experienced by a ceramic component are high then the component operates in the fast fracture regime and the ceramic component lifetime would be expected to be unpredictable and typically short. This graphic also shows that if flexure stress and temperature experienced by a ceramic component are low then the component operates in the no failure regime and the ceramic component lifetime would be expected to be predictable and typically long. If the flexure stress is high but the temperature is low then the component operates in a region characterized by Weibull strength variability. If the flexure stress is low but the temperature is high then the component operates in a region characterized by slow crack growth and the ceramic component lifetime would be expected to be somewhat unpredictable and variable.

Some gas turbine engines, especially microturbines, have used ceramic components in prototype situations. These have been used for relatively high temperatures and have operated in the slow crack growth region. These engines have experienced failure of the ceramic components. One of the design goals used in the present invention is to maintain ceramic component operation well inside the no failure regime so that incidences of component failure are minimized and component lifetime is maximized. A number of turbochargers have used ceramic components, most notably ceramic rotors, operating in the no failure region.

The following table shows some important properties of ceramics that are typically used for gas turbine components.

TABLE 1

| | Alumina | Cordierite | Silicon Carbide | Silicon Nitride | Mullite |
|---|---|---|---|---|---|
| Density (kg/m3) | 3,700-3,970 | 2,600 | 3,210 | 3,310 | 2,800 |
| Specific Heat (J/kg/K) | 670 | 1,465 | 628 | 712 | 963 |
| Thermal Conductivity (W/m/K) | 24 | 3 | 41 | 27 | 3.5 |
| Coefficient Thermal Expansion (μm/m/K) | 8.39 | 1.7 | 5.12 | 3.14 | 5.3 |
| Thermal Shock Resistance (ΔT (K)) | 200-250 | 500 | 350-500 | 750 | 300 |
| Maximum Use Temperature (K) | 3,925 | 1,645 | 1,675 | 1,775 | 1,975 |

Figure 3:
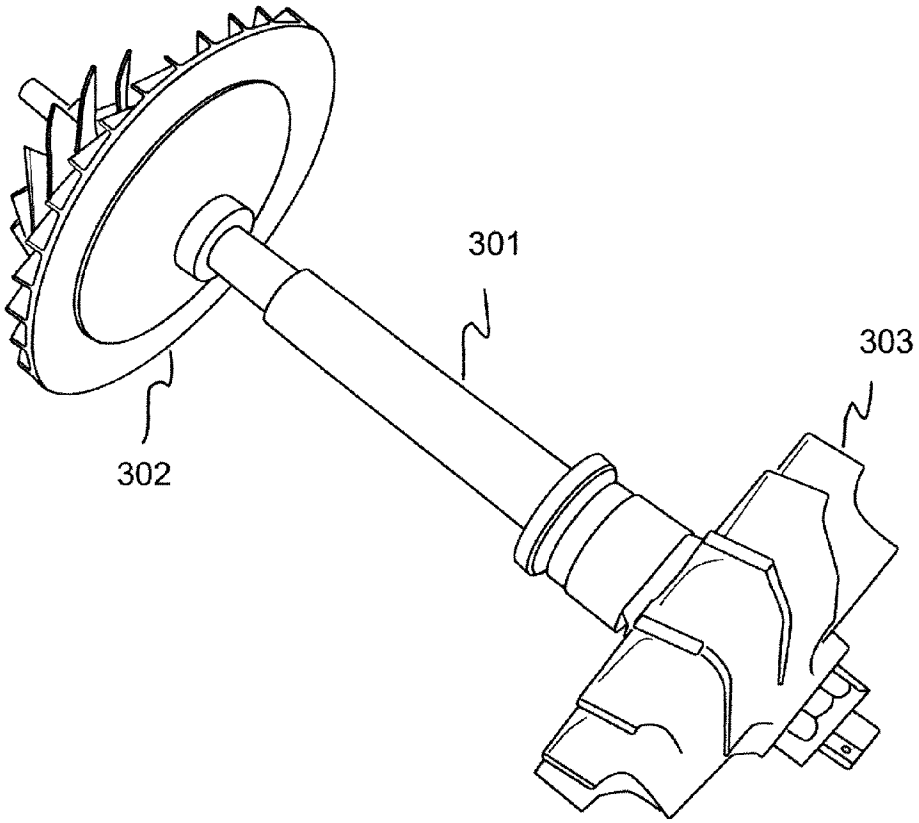
Figure 3 (Prior Art)
FIG. 3 is a schematic of a spool with a metallic compressor rotor and a ceramic turbine rotor. This is prior art.

FIG. 3 is a schematic of compressor-turbine spool with a metallic compressor rotor and a ceramic turbine rotor. This is prior art. This figure illustrates a compressor/turbine spool typical of the present invention. A metallic compressor rotor 302 and a ceramic turbine rotor 303 are shown attached to the opposite ends of a metal shaft 301. The ceramic rotor shown here is a representation of a 95-mm diameter rotor fabricated from silicon nitride that was designed for use in turbocharger applications.

Design with Axial Clearance Problem

Figure 4:
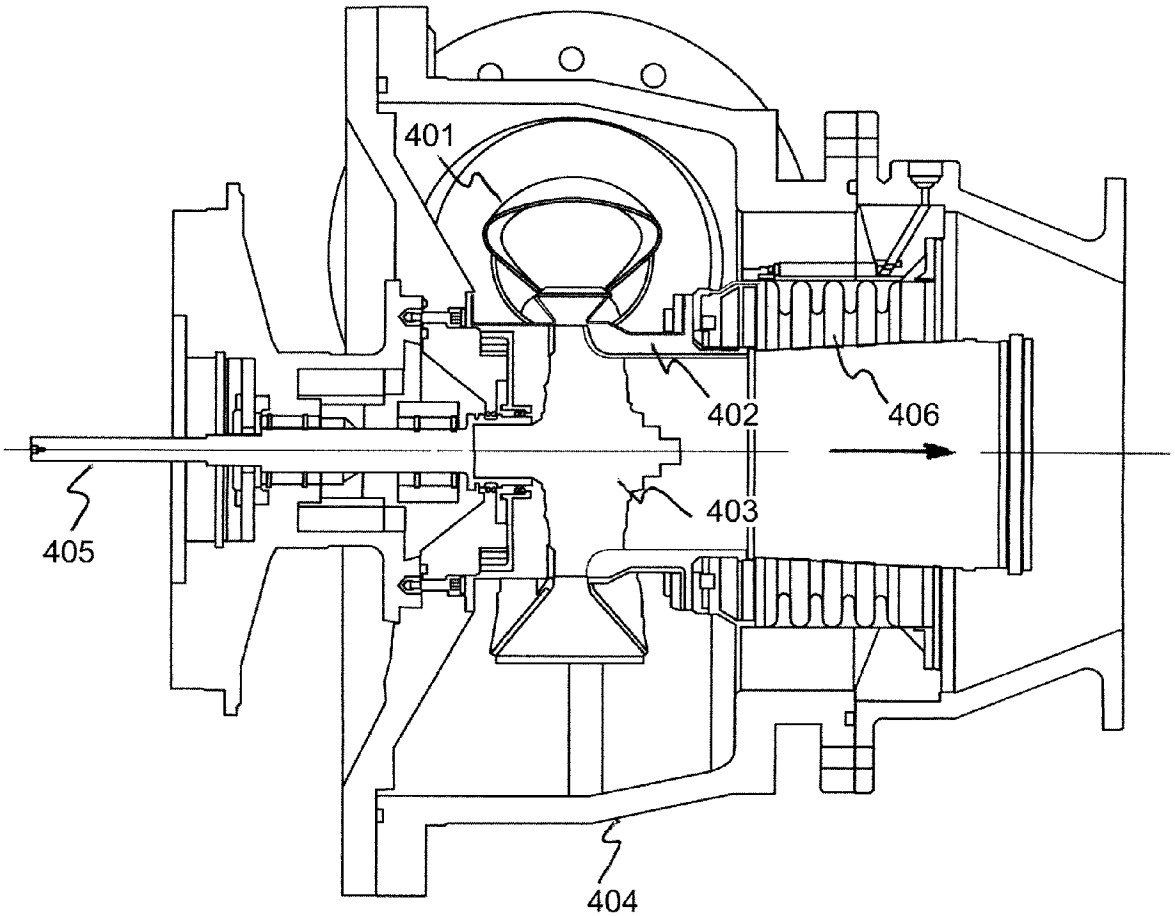
FIG. 4 is a schematic of a gas turbine compressor/turbine spool with ceramic and metallic components that has an axial clearance problem.

FIG. 4 is a schematic of a gas turbine compressor/turbine spool assembly with ceramic and metallic components. This configuration does not have active rotor/shroud clearance control but does have an unacceptable axial clearance growth problem when the assembly is heated to operational temperatures. A ceramic turbine rotor 403 is shown attached to a metallic shaft 405 which is attached to a metallic compressor rotor (not shown, see FIG. 3). Ceramic rotor 403 is separated by a small clearance gap (see FIG. 8 for detail) from a ceramic shroud 402. Ceramic shroud 402 is attached to a metallic volute 401. The ceramic shroud 402 is also attached to a compliant metallic bellows 406 which is, in turn, attached to an outer metal case 404. The metallic volute 401 can be fabricated from a high temperature alloy such as Hastelloy-X. The ceramic rotor 403 can be fabricated from silicon nitride, for example, and is capable of operating safely at turbine inlet temperatures in the approximate range of 1,400 K. Ceramic shroud 402 can be fabricated from silicon carbide, for example, and has a coefficient of thermal expansion similar to that of silicon nitride. The use of a rotor and shroud fabricated from the same or similar ceramics is designed to substantially maintain rotor/shroud radial clearance over a wide range of engine operating temperatures. In the design of FIG. 4, the metallic volute 401, which is exposed to turbine inlet temperatures is less likely to catastrophically fail than a ceramic volute such as described below in FIG. 9. However, there will be differential axial and radial expansion between the metallic volute 401 and ceramic shroud 402 which can result in growth of an axial clearance gap between ceramic rotor 403 and ceramic shroud 402. This, in turn, can lead to parasitic flow losses with the growth of an axial clearance gap between the rotor blade tips and the shroud as the shroud moves axially away from rotor 403 with increasing temperature of the assembly.

In this configuration, when the assembly is heated, ceramic rotor 403 and ceramic shroud 402 have approximately the same coefficient of thermal expansion and so they expand radially approximately by the same amount thus retaining the approximate initial radial clearance between rotor 403 and shroud 402. However, as the assembly is heated, case 404, the compliant bellows 406 and volute 401 all have coefficients of thermal expansion typical of metals and therefore expand much faster with increasing temperature than the ceramic rotor 403 and ceramic shroud 402. The metallic volute 401 is fixed in position with respect to case 404 as it is held within a circumferential groove in case 404. Nevertheless, the right side of the volute expands and pushes shroud 402 to the right. Case 404 and bellows 406 also expand to the right but the compliance of the bellows does not allow the case 404 to strongly pull shroud 402 to the right. The expansion of the metallic volute 401 does, however, cause the axial clearance between rotor and shroud to increase and increases the axial clearance gap beyond that which is desired.

Therefore, a preferable design would be a metallic volute interfaced with a ceramic shroud with a means of controlling the axial expansion of the shroud over the range of anticipated operating temperatures from idle through full power operation. Such a design should be capable of providing a means of limiting parasitic flow leakage from the high pressure side of the rotor 403 around the outside of the shroud 402.

Present Invention

Metallic Volute Ceramic Rotor/Shroud Embodiment

Figure 5:
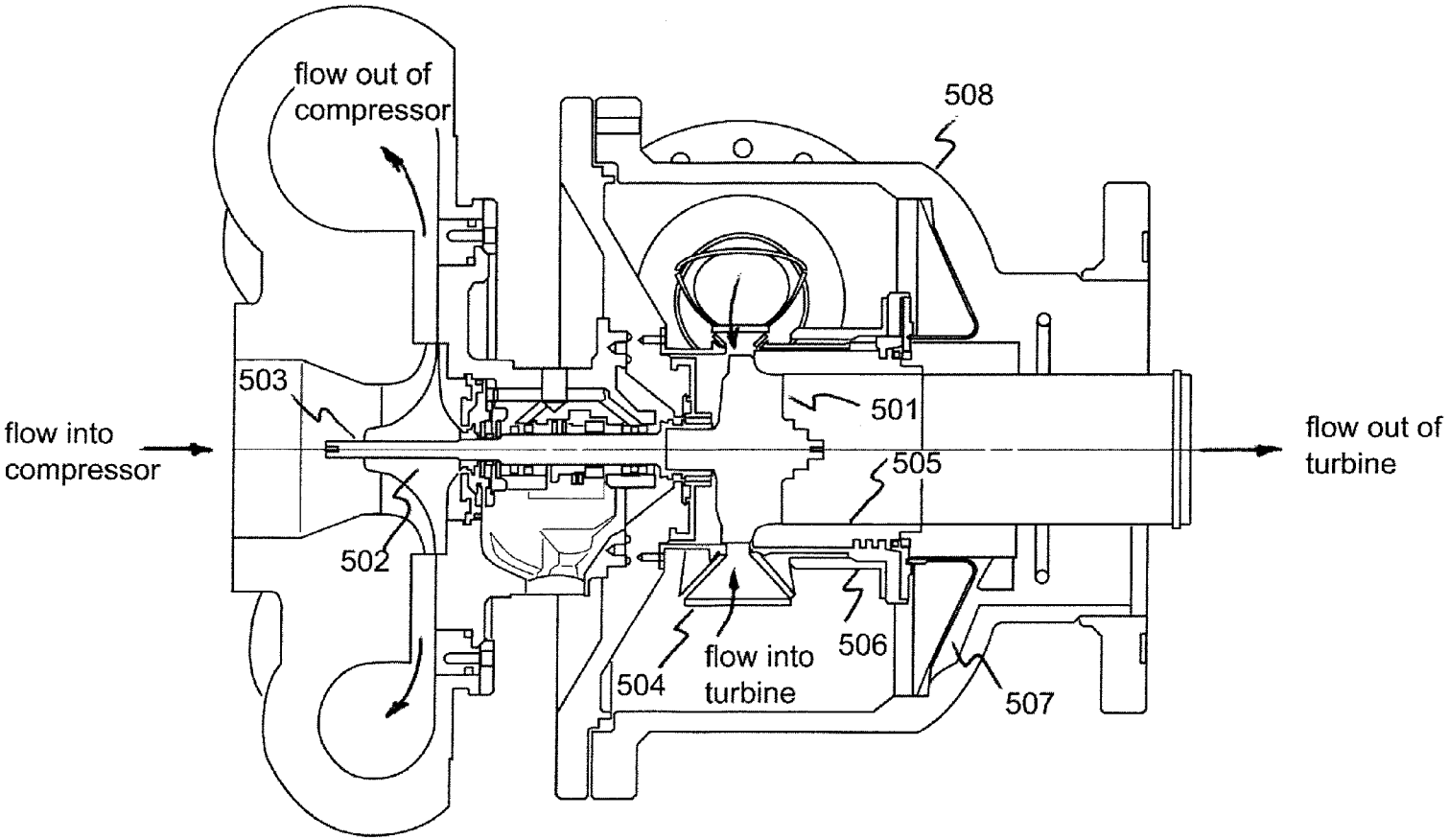
FIG. 5 is a schematic of a gas turbine compressor/turbine spool with ceramic and metallic components and active sealing.

FIG. 5 is schematic of a gas turbine compressor/turbine spool assembly with ceramic and metallic components and with an active clearance control system. In this embodiment, a ceramic turbine rotor 501 and a metallic compressor rotor 502 are shown on a metal spool shaft 503. The ceramic rotor 501 rotates just inside ceramic shroud 505, driven by gas entering via metallic volute 504. This configuration differs from that of FIG. 4 as the compliant bellows attachment means is replaced by an active clearance control means. This clearance control means is comprised of an impingement-cooled conical arm 507 and several moveable parts broadly shown as 506 which are moved by conical arm 507 during operation of the engine. The function of the clearance control means is to maintain a desired axial clearance between ceramic rotor 501 and the ceramic shroud 505 over the range of engine operating temperatures. Ceramic shroud 505 is connected by a metallic shroud carrier (item 703 of FIG. 7) which in turn is connected to metal housing 508. As the operating temperature varies over the power range of the engine, the metal case 508 to which the ceramic shroud carrier is attached moves axially with respect to the ceramic rotor. However, ceramic shroud 505 slides within the shroud carrier thus allowing the clearance gap between ceramic rotor 501 and ceramic shroud to remain substantially constant as described in more detail in FIG. 8. The way in which all these parts function with varying temperature is described fully in FIG. 8. As will also be apparent from FIG. 8, metallic volute 504 is not attached to ceramic shroud 501 but rather the two components can slide axially relative to one another. The impingement cooling of conical arm 507 is provided by a cooler air flow bled from the output of the high pressure compressor (commonly the bleed gas flow is in a temperature range of about 400 K to about 800 K, more commonly of about 450 K to about 700 K, more commonly of about 475 K to about 600 K, and even more commonly of about 500 K to about 530 K) and directed via a small channel to the region to the right of the flexing section of conical arm 507. The temperature of the bleed air or gas from the high pressure compressor output is commonly between about 35% to 50% of the output temperature of the high pressure turbine gas outlet.

As in the configuration described in FIG. 4, metallic volute 504 can be fabricated from a high temperature alloy such as Hastelloy-X, ceramic rotor 501 can be fabricated from silicon nitride, for example, and ceramic shroud 505 can be fabricated from silicon carbide, for example.

Figure 6B:
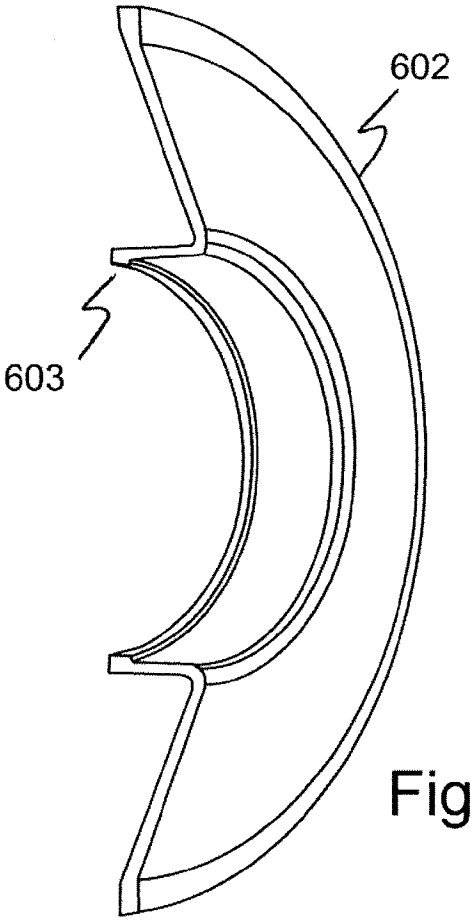
FIGS. 6*a-b* are schematics of a metallic conical arm for controlling clearances.
Figure 6A:
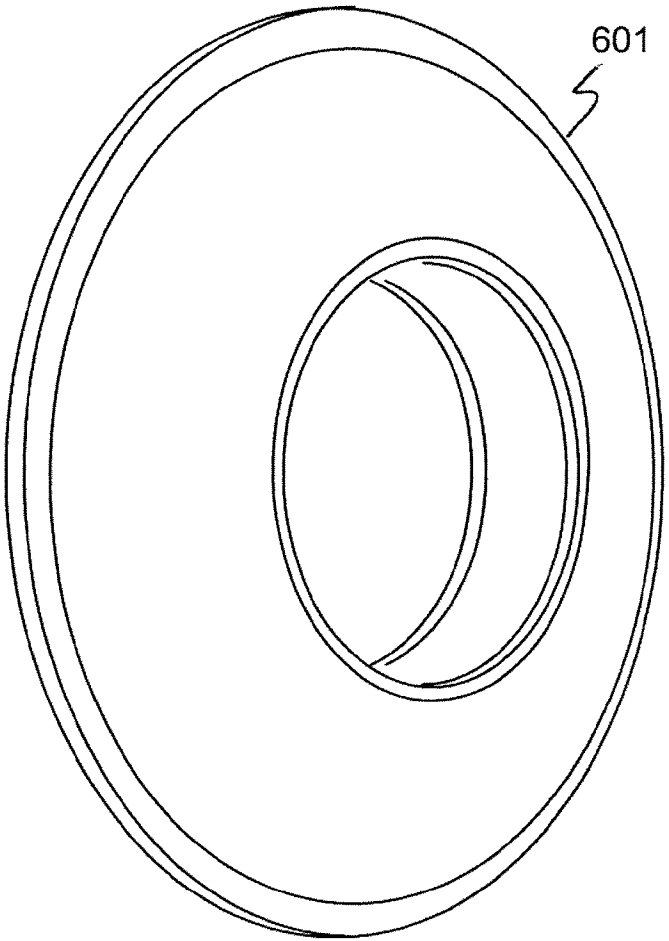
Figure 7D:
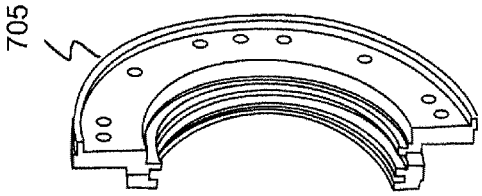
FIGS. 7*a-d* are schematics of a metallic volute and ceramic shroud components.
Figure 7C:
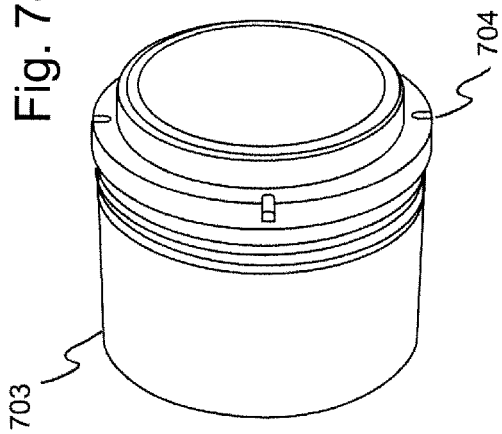
Figure 7B:
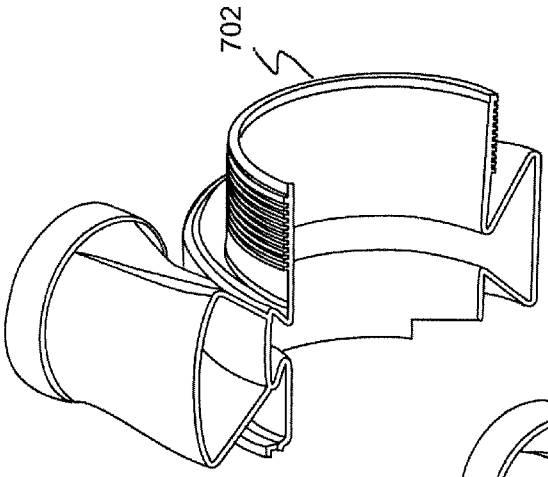
Figure 7A:
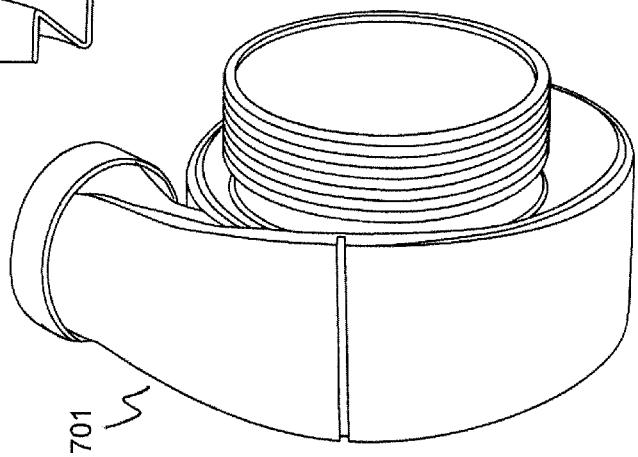

FIG. 6 is a schematic of a metallic conical arm for controlling clearances. FIG. 6*a* shows an isometric view of the conical arm 601. FIG. 6*b* shows a cut away view of the conical arm and shows a cylindrical pusher section 603 and a conical flexing section 602. The cylindrical pusher section 603 is also referred to as an armature. When there is no impingement cooling, the temperature of the conical flexing section 602 ranges from about 800 to about 1,080 K. When there is impingement cooling, the temperature of the conical flexing section 602 is lower than in the absence of such cooling. When there is impingement cooling, commonly the temperature of the conical flexing section 602 is less than about 800 K, more commonly ranges from about 450 K to about 750 K, and even more commonly ranges from about 575 K to about 725 K. This cooling of the conical arm causes it to push the sealing mechanism and ceramic shroud to the left (as viewed in FIG. 5), thereby maintaining the desired clearance between the ceramic rotor and ceramic shroud. The above temperature ranges are typical for a specific engine configuration and are given to illustrate the principle of operation of the conical arm.

FIG. 7 is a schematic of a metallic volute and ceramic shroud components. FIG. 7*a* shows a metallic volute 701 which is typically a cast component. FIG. 7*b* shows an isometric cutaway view of the metallic volute showing circumferential rings and grooves 702 that serve as a labyrinth seal as described more fully in FIG. 8. FIG. 7*c* shows a ceramic shroud 703 with pins 704 that position and hold the shroud with respect to the shroud carrier. A two piece (clamshell) metallic shroud carrier 705 is shown in FIG. 7*d*. This shroud carrier adapts the shroud 703 to a metal case (shown below in FIG. 8). For example, if the shroud carrier 703 is fabricated from Hastelloy-X and the shroud is fabricated from silicon carbide ceramic, the coefficient of thermal expansion of the metallic shroud carrier, which in turn is attached to the metal case (see FIG. 5), is larger than the coefficient of thermal expansion of the ceramic shroud, commonly being approximately 3 times that of the ceramic shroud. The coefficient of thermal expansion of the metallic shroud carrier may be the same or different than the coefficient of thermal expansion of the metallic volute. This differential expansion will lead to axial movement of the shroud relative to the ceramic rotor since the shroud carrier moves with the metal case. If the axial clearance between the rotor and shroud is not controlled, then parasitic flow leakage will occur around the rotor blade tips and inside of the shroud. This parasitic leakage can cause an overall engine efficiency in the range of about ½% to about 2%. It can also lead to increased erosion of the rotor blade tips and upstream edge of the shroud. The present disclosure can substantially minimize parasitic leakage and provide a higher overall engine efficiency.

Figure 8:
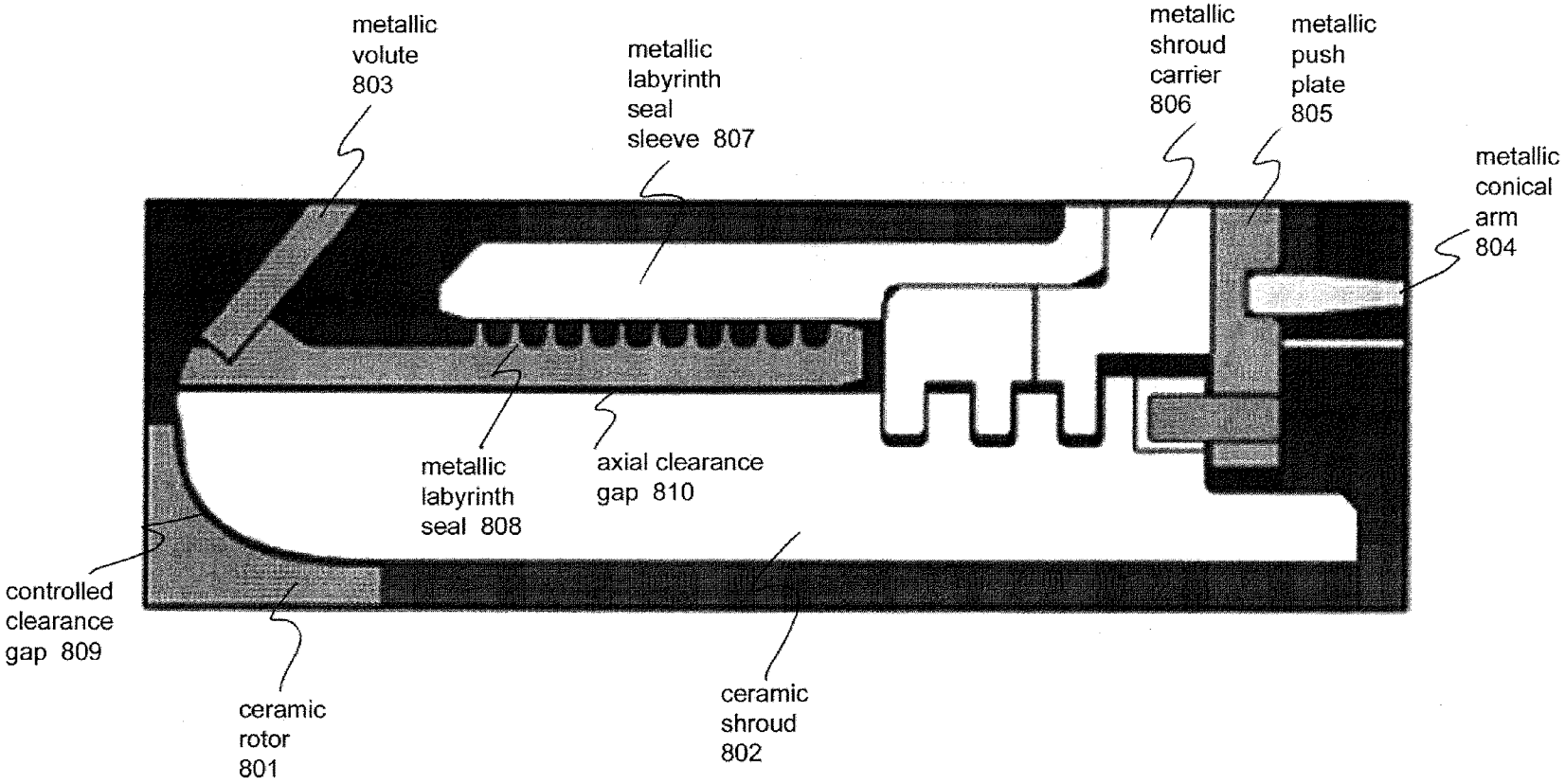
FIG. 8 is a schematic of the details of the interface and sealing system between a ceramic shroud and a metallic shroud carrier.

FIG. 8 is a schematic of the details of the active clearance control for maintaining a desired clearance 809 between ceramic rotor 801 and ceramic shroud 802. This figure shows a ceramic rotor 801 separated from a ceramic shroud 802 by a small clearance gap 809 which allows ceramic rotor 801 to rotate freely relative to ceramic shroud 802. This figure also shows the sealing system between the metallic volute 803 and ceramic shroud 802. The metallic volute 803 is attached to a metallic labyrinth seal cylinder 808. The sealing system allows the ceramic shroud 802 to slide axially relative to the metallic volute 803. The labyrinth seal is provided by the circumferential rings shown on the outside of the labyrinth seal cylinder 808. A metallic conical arm 804 is shown inserted into a metallic push plate 805 which in turn is in contact with metallic shroud carrier 806. Metallic conical arm 804 is referred to as an armature and is the cylindrical pusher section shown as item 603 of FIG. 6. The shroud carrier 806 is a two piece component described previously in FIG. 7*d*. A metallic labyrinth seal sleeve 807 holds the various components in place and its inside diameter forms a sealing surface for the labyrinth seal teeth on labyrinth seal cylinder 808.

As noted in FIG. 4, the use of a rotor and shroud fabricated from the same or similar ceramics is designed to substantially maintain rotor/shroud radial clearance over a wide range of engine operating temperatures.

The coefficient of thermal expansion of the metallic components are substantially greater than that of the ceramic components. For example, thermal expansion of a Hastelloy-X shroud carrier is 3 times that of a silicon carbide shroud.

Ceramic shroud 802 is connected by a metallic shroud carrier 806 which is ultimately connected to the metallic turbine case or housing (item 508 in FIG. 5). As the operating temperature of the gas turbine engine varies, the ceramic shroud 802 moves axially with respect to ceramic rotor 809. In the absence of an active clearance control system, the axial clearance gap 809 would increase as the operating temperature of the turbine increases. As this clearance gap increases, more of the flow through the turbine bypasses the turbine blades by flowing through gap 809 causing a decrease in turbine efficiency.

When the conical arm 804 (shown in full in FIG. 6) is cooled by impingement cooling, the cylindrical pusher section of conical arm 804 is forced to the left (as viewed in FIG. 5 and FIG. 8), pushing on pusher plate 805 which then moves shroud carrier 806 and shroud 802 to the left, in a direction that decreases clearance gap 809. By controlling the amount of impingement cooling of the conical arm, the tendency of the gap to increase by the expansion of the metal turbine housing (item 508 in FIG. 5) is balanced by the action of the conical arm which tends to decrease clearance gap 809. With proper design of the impingement cooling air flow and conical arm, the clearance control system can automatically maintain an approximately constant width of clearance gap 809 over most or all of the operating conditions of the engine (from idle to full power). This in turn maintains the desired optimum clearance between ceramic rotor 801 and ceramic shroud 802 and thereby minimizes leakage of gas flow between the rotor blades and shroud. This clearance control system thus allows metallic and ceramic components to be used without compromising overall engine efficiency.

Figure 9:
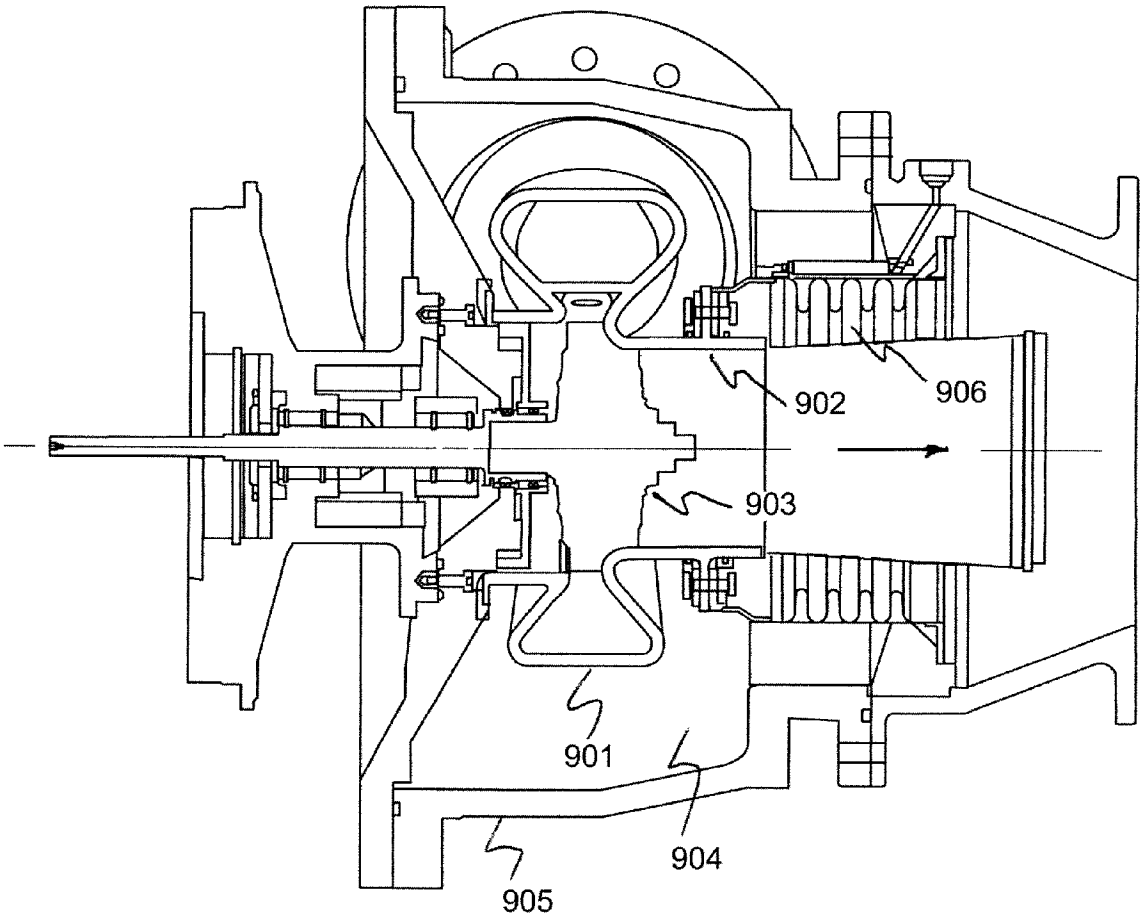
FIG. 9 is schematic of a gas turbine compressor/turbine spool with a one piece ceramic volute and shroud.

The configuration shown in FIGS. 4, 5 and 9 are all based on a gas turbine engine design in which the full power mass flow rate is approximately 1.25 kg/s; the two-stage compression ratio is about 15, the high pressure turbine inlet temperature is about 1,400 K and the full shaft power of the free power turbine is about 375 kW. The diameter of the ceramic turbine rotor is about 95-mm and the desired clearance gap between the ceramic rotor and shroud is about 0.38 mm. Without impingement cooling, the axial motion of the shroud with respect to the rotor at operating temperature is in the range of 0.7 to 1 mm which will substantially increase the clearance gap between the ceramic rotor and shroud. This illustrates the importance of the impingement-cooling-driven clearance control system of FIG. 8. Without this system, the clearance gap between the ceramic rotor and shroud increases from the desired 0.38 mm to as much as 1 mm, or a potential three-fold increase in gap width which, in turn, would result in an approximately three-fold increase in leakage mass flow rate.

As can be appreciated, the impingement-cooling-driven clearance control method described in FIG. 8 can be applied to any spool of any size gas turbine engine.

Ceramic Volute, Rotor and Shroud Embodiment

FIG. 9 is schematic of a gas turbine compressor/turbine spool assembly with ceramic and metallic components. A ceramic turbine rotor 903 is shown separated by a small clearance gap from a ceramic shroud 902 which is integral with a ceramic volute 901. The volute, shroud and rotor are housed inside a metal case 904. The ceramic shroud 902 is also attached to a compliant metallic bellows 906 which is attached to an outer metal case 905. For example the ceramic rotor 903 can be fabricated from silicon carbide and is capable of operating safely at turbine inlet temperatures in the approximate range commonly of from about 850 to about 1,800 K, more commonly of from about 950 to about 1,650 K and even more commonly of about 1,400 K. Ceramic shroud 902 and volute 901 can be fabricated from silicon carbide, for example, which has a coefficient of thermal expansion similar to that of silicon nitride used for rotor 903.

In this embodiment, when the assembly is heated during engine operation, the ceramic rotor 903 and ceramic shroud 902 have approximately the same coefficient of thermal expansion and so they expand radially approximately by the same amount thus retaining the approximate initial radial clearance between rotor 903 and shroud 902. The right side of ceramic volute 901 expands at approximately the same rate as ceramic shroud 902 and tends to push shroud 902 to the right but only by a small amount. As the assembly is heated, case 905 and bellows 906 have coefficients of thermal expansion typical of metals. Case 905 and compliant metallic bellows 906 also expand to the right but the compliance of the bellows does not allow the case 905 to pull shroud 902 to the right. The expansion of the ceramic volute 901 is relatively small and does not cause the axial clearance gap between rotor and shroud to increase beyond that which is desired.

The use of a rotor and volute/shroud fabricated from the same or similar ceramics adequately thus controls radial and axial shroud clearances between the rotor 903 and shroud 902 and maintains high rotor efficiency by controlling the clearance and minimizing parasitic flow leakages between the rotor blade tips and the shroud.

The advantages of this design approach are:

- similar coefficient of thermal expansion of ceramic volute/shroud and rotor gives excellent shroud clearance control
- maintains good form stability—will keep its shape at high temperatures
- has good thermal shock properties
- allows complicated shapes can be easily cast
- is cost effective compared to high temperature turbine metals The temperature of the flow exiting the combustor into the volute that directs the flow to the high pressure turbine may be in substantially the same range as the turbine inlet temperature. The temperature of the flow exiting the high pressure turbine into the shroud that directs the flow towards the low pressure turbine may be in the range of from about 1,000 to about 1,400 K, more commonly from about 1,000 to about 1,300 K, and even more commonly of approximately 1,200 K. Stated differently, the inlet temperature of the high pressure turbine is commonly higher than, more commonly about 5% higher than, more commonly about 10% higher than, more commonly about 15% higher than, and even more commonly about 20% higher than the high pressure turbine gas outlet temperature. A one-piece volute and shroud may be exposed to a temperature differential in the range of about 100 K to about 300 K and more commonly about 160 K to about 200 K.

The disadvantages of this design approach are:

- the amount of stress that can be sustained at high temperature in the volute is unpredictable (especially if the materials operate in the slow crack growth or fast fracture regions as shown in FIG. 3)
- the potential for catastrophic failure of the volute is significant since ceramics generally don't yield, they behave elastically until they fracture and break abruptly This design of a single piece or two piece ceramic volute and shroud for use with a ceramic turbine rotor is preferred if the ceramic material used can be operated well within the no failure region as shown in FIG. 3.

Figure 10B:
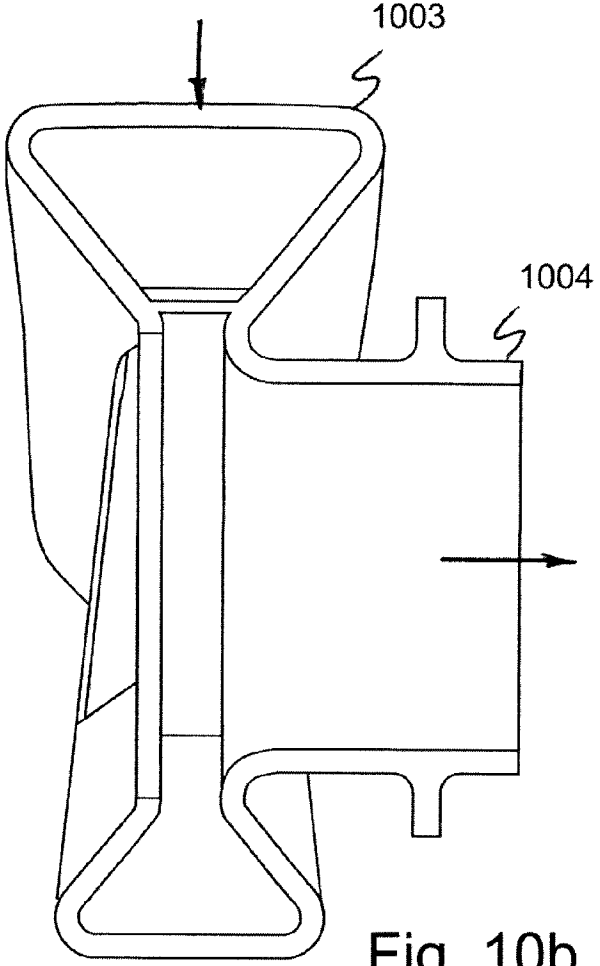
FIGS. 10*a-b* are schematics of a ceramic volute and shroud.
Figure 10A:
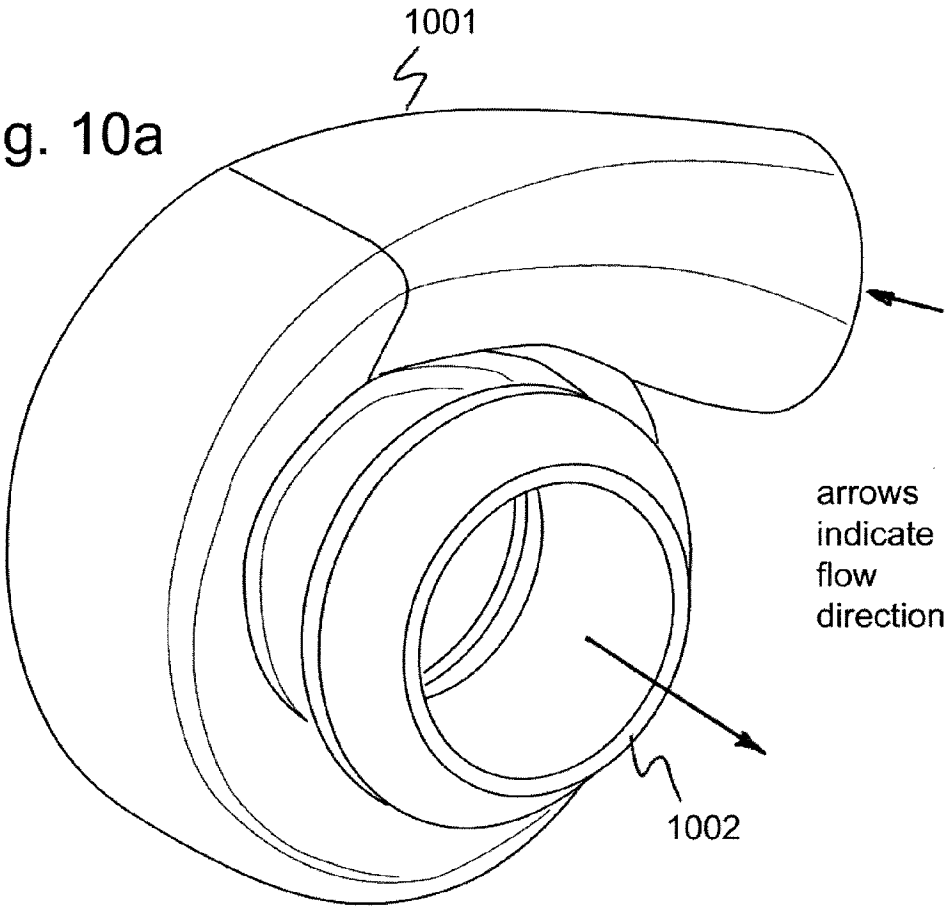

FIG. 10 is a schematic of an example of a two piece ceramic volute and shroud such as described in FIG. 9. FIG. 10*a* is an isometric view showing the volute 1001 and the shroud 1002. The volute/shroud can be made in one piece or multiple pieces. A typical material for such a volute/shroud is silicon carbide. FIG. 10*b* shows a side cutaway view again illustrating the volute 1003 and the shroud 1004. Arrows indicate flow direction.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

A number of variations and modifications of the inventions can be used. As will be appreciated, it would be possible to provide for some features of the inventions without providing others.

The present invention, in various embodiments, includes components, methods, processes, systems and/or apparatus substantially as depicted and described herein, including various embodiments, sub-combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, for example for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A gas turbine engine, comprising:

at least one turbo-compressor spool assembly, wherein the at least one turbo-compressor spool assembly comprises a compressor in mechanical communication with a turbine, a volute directing an inlet gas towards an inlet of a rotor of the turbine and a shroud adjacent to the rotor of the turbine, the shroud directing an outlet gas towards an outlet of the at least one turbo-compressor spool assembly; and a clearance control device to substantially maintain, during the at least one turbo-compressor spool assembly operation, an operational clearance between the rotor and shroud at a level no greater than about 110% of a non-operational clearance between the rotor and shroud when the at least one turbo-compressor spool assembly is non-operational; and wherein the clearance control device comprises: (a) a metallic shroud carrier connected to an engine housing and case and to the shroud, the shroud being ceramic, (b) a labyrinth metallic seal sleeve, and (c) the volute comprising a labyrinth seal engaging the labyrinth metallic seal sleeve, the labyrinth seal and seal sleeve sealing substantially against gas flow.

2. The engine of claim 1, wherein an inlet gas to the turbine is heated by a fuel combustor, wherein the inlet gas has a temperature of from about 1,000 K to about 1,400 K, and the outlet gas has a temperature less than the inlet gas, the outlet gas temperature ranging from about 900 K to about 1,200 K, whereby the shroud is subjected to a temperature differential ranging from about 200 K to about 400 K.

3. The engine of claim 2, wherein the rotor and shroud comprise a ceramic material of substantially identical thermal expansion characteristics and wherein the volute interfaces with the ceramic shroud.

4. The engine of claim 2, wherein the shroud and the volute interfacing with the shroud each comprise a substantially identical ceramic composition.

5. The engine of claim 3, wherein the volute comprises circumferential rings and grooves to form the labyrinth seal.

6. The engine of claim 5, wherein the shroud carrier is positioned between the volute and ceramic shroud and wherein a coefficient of thermal expansion of the shroud carrier is larger than a coefficient of thermal expansion of the ceramic shroud.

7. The engine of claim 1, wherein the clearance control device comprises an armature attached to an engine component and to the shroud carrier, the armature being cooled, during at least one turbo-compressor spool assembly operation, by a cooling fluid having a temperature less than the outlet gas temperature.

8. The engine of claim 7, wherein the cooling fluid is a gas removed from an input gas to at least one of the compressor, a combustor, and a recuperator.

9. The engine of claim 7, wherein the cooling fluid has a temperature of from about 400 to about 800 K and wherein the armature is metallic.

10. A method, comprising:

providing an engine comprising at least one turbo-compressor spool assembly, wherein the at least one turbo-compressor spool assembly comprises a compressor in mechanical communication with a turbine, a volute adjacent to a rotor of the turbine directing an inlet gas towards an inlet of the turbine rotor, and a shroud adjacent to the turbine rotor, the shroud directing an outlet gas towards an outlet of the at least one turbo-compressor spool assembly;

substantially maintaining, during the at least one turbo-compressor spool assembly operation, an operational clearance between the rotor and shroud at a level no greater than about 110% of a non-operational clearance between the rotor and shroud when the at least one turbo-compressor spool assembly is non-operational; and wherein the engine further comprises (a) a metallic shroud carrier connected to an engine housing and case and to the shroud, the shroud being ceramic, (b) a labyrinth metallic seal sleeve, and (c) the volute comprising a labyrinth seal engaging the labyrinth metallic seal sleeve, the labyrinth seal and seal sleeve sealing substantially against gas flow.

11. The method of claim 10, wherein the inlet gas to the turbine is heated by a fuel combustor, the inlet gas has a temperature of from about 1,000 K to about 1,400 K, and the outlet gas has a temperature less than the inlet gas, the outlet gas temperature ranging from about 900 K to about 1,200 K, whereby the shroud is subjected to a temperature differential ranging from about 200 K to about 400 K.

12. The method of claim 11, wherein the rotor and shroud each comprise a ceramic material of substantially identical thermal expansion characteristics and wherein the volute is in mechanical communication with the ceramic shroud.

13. The method of claim 11, wherein the shroud is in mechanical communication with the volute, and the shroud and volute each comprise a substantially identical ceramic composition.

14. The method of claim 13, wherein the volute comprises circumferential rings and grooves to form the labyrinth seal.

15. The method of claim 12, wherein the shroud carrier is positioned between the volute and ceramic shroud and wherein a coefficient of thermal expansion of the shroud carrier is larger than a coefficient of thermal expansion of the ceramic shroud.

16. The method of claim 10, wherein the engine further comprises an armature attached to an engine component and to the shroud carrier and further comprising:

contacting at least one of the shroud carrier and armature, during the at least one turbo-compressor spool assembly operation, with a cooling fluid having a temperature less than the outlet gas temperature to cool the at least one of the shroud carrier and armature.

17. The method of claim 16, wherein the cooling fluid is a gas removed from an input gas to at least one of the compressor, a combustor, and a recuperator.

18. The method of claim 16, wherein the cooling fluid has a temperature of from about 400 to about 800 K and wherein the armature is nonceramic.

19. A gas turbine engine, comprising:

at least one turbo-compressor spool assembly, wherein the at least one turbo-compressor spool assembly comprises a compressor in mechanical communication with a turbine, a volute directing an input gas to a rotor of the turbine, and a shroud adjacent to the turbine rotor, the shroud directing an outlet gas towards an outlet of the at least one turbo-compressor spool assembly, wherein the volute and shroud each comprise a ceramic material to maintain, during the at least one turbo-compressor spool assembly operation, at least an operational clearance between the rotor and shroud of no more than about 110% of a non-operational clearance between the rotor and shroud when the at least one turbo-compressor spool assembly is non-operational; and wherein the gas turbine engine further comprises (a) a metallic shroud carrier connected to an engine housing and case and to the shroud (b) a labyrinth metallic seal sleeve, and (c) the volute comprising a labyrinth seal engaging the labyrinth metallic seal sleeve, the labyrinth seal and seal sleeve sealing substantially against gas flow.

20. The engine of claim 19, wherein the rotor comprises a ceramic material and further comprising:

a clearance control device to substantially maintain, during the at least one turbo-compressor spool assembly operation, the operational clearance between the rotor and shroud at a level no greater than the non-operational clearance between the rotor and shroud when the at least one turbo-compressor spool assembly is non-operational.

21. The engine of claim 19, wherein the ceramic composition is one or more of alumina, cordierite, silicon carbide, silicon nitride, and mullite.

22. The engine of claim 19, wherein the rotor comprises a ceramic material and wherein the rotor, volute, and shroud have substantially the same coefficient of thermal expansion and thermal contraction.

* * * * *